US012649996B2

(12) United States Patent
Whitford

(10) Patent No.: US 12,649,996 B2
(45) Date of Patent: Jun. 9, 2026

(54) VEHICLE MITIGATION SYSTEM

(71) Applicant: Peter Duncan Whitford, Pasadena, CA (US)

(72) Inventor: Peter Duncan Whitford, Pasadena, CA (US)

( * ) Notice: Subject to any disclaimer, the term of this patent is extended or adjusted under 35 U.S.C. 154(b) by 227 days.

(21) Appl. No.: 18/140,616

(22) Filed: Apr. 28, 2023

(65) Prior Publication Data

US 2023/0349116 A1 Nov. 2, 2023

Related U.S. Application Data

(60) Provisional application No. 63/336,288, filed on Apr. 28, 2022.

(51) Int. Cl.
*E01F 13/12* (2006.01)
*E01F 13/02* (2006.01)

(52) U.S. Cl.
CPC ..... *E01F 13/12* (2013.01); *E01F 13/02* (2013.01)

(58) Field of Classification Search
CPC . E01F 13/00; E01F 13/02; E01F 13/04; E01F 13/12; E01F 15/145; E01F 15/148
See application file for complete search history.

(56) References Cited

U.S. PATENT DOCUMENTS

| | | | |
|---|---|---|---|
| 1,449,518 | A | 3/1923 | Lawson |
| 1,631,416 | A | 6/1927 | Howard |
| 2,777,227 | A | 1/1957 | Imhoff |
| 3,065,680 | A | 11/1962 | Wiedman, Sr. |
| 3,135,062 | A | 6/1964 | Guerco |
| 4,480,405 | A | 11/1984 | Ferguson |
| 4,630,395 | A | 12/1986 | Nasatka |
| 4,854,767 | A | 8/1989 | Sasaki |
| 4,968,177 | A | 11/1990 | Bechtold |
| 4,998,843 | A | 3/1991 | Mothe |
| 5,145,278 | A | 9/1992 | Lohrmann |
| 5,228,237 | A | 7/1993 | Nasatka |
| 5,356,119 | A | 10/1994 | Schock |
| 5,549,410 | A | 8/1996 | Beryozkin et al. |
| 5,997,211 | A | 12/1999 | Chou |
| 6,079,904 | A | 6/2000 | Trisl |

(Continued)

FOREIGN PATENT DOCUMENTS

| | | | |
|---|---|---|---|
| DE | 19516597 | A1 | 11/1996 |
| EP | 3792401 | B1 | 7/2022 |

(Continued)

OTHER PUBLICATIONS

Meridian Rapid Defense Group—YouTube video titled "Meridian® Vehicle Barriers at Work Across the Globe", published Nov. 11, 2020, https://www.youtube.com/watch?v=afg2fQr3Wfk. (Year: 2020).*

(Continued)

*Primary Examiner* — Jonathan P Masinick
(74) *Attorney, Agent, or Firm* — Patterson + Sheridan, LLP

(57) ABSTRACT

A vehicle mitigation system includes a first portable barrier, a second portable barrier positioned in proximity to the first portable barrier but separated by a spacing distance. The vehicle mitigation system further includes at least one arrestor cable attached between the first portable barrier and the second portable barrier such that the arrestor cable spans the spacing distance between the first and second portable barriers.

29 Claims, 19 Drawing Sheets

(56) References Cited

U.S. PATENT DOCUMENTS

| | | | | |
|---|---|---|---|---|
| 6,296,234 | B1 | 10/2001 | De Boer | |
| 6,679,649 | B1 | 1/2004 | Capolupo | |
| 6,702,512 | B1 | 3/2004 | Reale | |
| 6,767,158 | B1 | 7/2004 | Consolazio et al. | |
| 6,843,614 | B2 | 1/2005 | Yodock, Jr. et al. | |
| 6,886,299 | B2 | 5/2005 | Gower | |
| 6,907,811 | B2 | 6/2005 | White | |
| 6,962,245 | B2 | 11/2005 | Ray et al. | |
| 7,083,357 | B2 | 8/2006 | Lamore | |
| 7,101,112 | B2 | 9/2006 | Burns et al. | |
| 7,140,802 | B2 | 11/2006 | Lamore | |
| 7,172,176 | B1 | 2/2007 | Eastland | |
| 7,230,180 | B2 * | 6/2007 | Frank | D07B 1/068 174/110 R |
| 7,264,417 | B1 | 9/2007 | Nasatka | |
| 7,320,557 | B1 | 1/2008 | Potter | |
| 7,494,112 | B2 | 2/2009 | Fromm | |
| 7,819,604 | B2 | 10/2010 | Breed | |
| 7,918,622 | B2 | 4/2011 | Whitford | |
| 7,959,373 | B1 | 6/2011 | Brown | |
| 8,215,866 | B2 | 7/2012 | Whitford | |
| 10,322,911 | B2 * | 6/2019 | Vincenti | B66C 1/12 |
| 10,407,852 | B2 | 9/2019 | Dickinson et al. | |
| 10,508,393 | B1 * | 12/2019 | Page | E01F 13/02 |
| 10,780,302 | B2 * | 9/2020 | West | A62C 2/10 |
| 10,900,182 | B2 | 1/2021 | Harris et al. | |
| 10,941,531 | B2 | 3/2021 | Dickinson et al. | |
| 11,155,352 | B2 * | 10/2021 | Azeredo | D07B 1/0673 |
| 2002/0182007 | A1 | 12/2002 | Yodock, Jr. et al. | |
| 2003/0159356 | A1 | 8/2003 | Russell | |
| 2004/0089143 | A1 | 5/2004 | Gilon | |
| 2005/0220536 | A1 | 10/2005 | Blair et al. | |
| 2005/0254892 | A1 | 11/2005 | Yodock, III et al. | |
| 2006/0078380 | A1 | 4/2006 | Dehart | |
| 2006/0233607 | A1 | 10/2006 | Buckley et al. | |
| 2007/0272911 | A1 | 11/2007 | Fromm | |
| 2008/0157493 | A1 | 7/2008 | McConkey et al. | |
| 2008/0223857 | A1 | 9/2008 | Palley et al. | |
| 2009/0067923 | A1 | 3/2009 | Whitford | |
| 2009/0092443 | A1 | 4/2009 | Friedman et al. | |
| 2009/0208274 | A1 * | 8/2009 | Liang | F16G 15/08 403/164 |
| 2009/0250674 | A1 | 10/2009 | Darcy | |
| 2010/0202829 | A1 | 8/2010 | Gelfand et al. | |
| 2011/0271597 | A1 | 11/2011 | Wilkinson et al. | |
| 2012/0168702 | A1 * | 7/2012 | Fromm | F41H 5/045 89/929 |
| 2012/0177439 | A1 * | 7/2012 | More | E01F 13/12 404/6 |
| 2015/0033515 | A1 * | 2/2015 | Lai | F16B 45/024 24/601.5 |
| 2016/0053450 | A1 | 2/2016 | Neusch | |
| 2016/0160459 | A1 | 6/2016 | Orner, Jr. | |
| 2017/0204575 | A1 | 7/2017 | Klein | |
| 2017/0356203 | A1 | 12/2017 | Nagel | |
| 2019/0226167 | A1 | 7/2019 | Gerrard et al. | |
| 2019/0330812 | A1 | 10/2019 | Ptacek et al. | |
| 2020/0063387 | A1 * | 2/2020 | Klein | E01F 13/022 |
| 2020/0173121 | A1 * | 6/2020 | Klein | E01F 13/12 |
| 2022/0259889 | A1 | 8/2022 | Jordan | |
| 2022/0298733 | A1 * | 9/2022 | Graziadei | E01F 13/12 |
| 2023/0257946 | A1 | 8/2023 | Whitford | |

FOREIGN PATENT DOCUMENTS

| | | | |
|---|---|---|---|
| GB | 158281 | A | 2/1921 |
| GB | 2178094 | A | 2/1987 |
| WO | 2006/088428 | A1 | 8/2006 |
| WO | 2007040626 | A2 | 4/2007 |
| WO | 2020170282 | A1 | 8/2020 |
| WO | 2023/229788 | A2 | 11/2023 |

OTHER PUBLICATIONS

Meridian Rapid Defense Group—YouTube video titled "Archer® Beam Gate Deployment and Use", published Nov. 11, 2020, https://www.youtube.com/watch?v=a5EqkkAh-dY. (Year: 2019).*

International Search Report and Written Opinion dated Nov. 17, 2023, prepared in International Application No. PCT/US2023/032320.

Meridian Rapid Defense Group, Archer Beam Gate Deployment and Use. YouTube. Sep. 5, 2019. [Retrieved on Oct. 23, 2019]. Retrieved from Internet: ,URL: https://www.youtube.com/watch?v=a5EqkkAh-dY. entire video.

Fromm Barriers, Inc., Instant Protection When the Clock is Ticking, at least as early as Sep. 2006, 2 pages.

Meridian Rapid Defense Group, Better Barriers for the 21st Century—Archer 1000 Anti-Vehicle Barrier System, The Wayback Machine—https://web.archive.org/web/20090804105407/http://www.betterbarriers.com:80/products/archer1000/, at least as early as Aug. 4, 2009.

Meridian Rapid Defense Group, Better Barriers for the 21st Century—Transportation Products, The Wayback Machine—https://webarchive.org/web/20090804105417/http://www.betterbarriers.com:80/products/transportation/, at least as early as Aug. 4, 2009.

Meridian Rapid Defense Group, Better Barriers for the 21st Century—Archer 500, undated but at least as early as Mar. 27, 2014.

Meridian Rapid Defense Group, Better Barriers for the 21st Century—Archer 750, undated but at least as early as Jan. 8, 2016.

Meridian Rapid Defense Group, Better Barriers for the 21st Century—Rapid Gate, Archer Beam Gate, Archer Active Gate, The Wayback Machine—https://web.archive.org/web/20090803215738/http://www.betterbarriers.com:80/products/rapid_gate/, 2009 Meridian Rapid Defense Group, LLC, at least as early as Aug. 3, 2009.

Delta Scientific Corporation Portable Barriers:MP5000 posted on DeltaScientific.com original date unknown. Publication date unknown—first cited to the USPTO on Jul. 22, 2008 in U.S. Pat. No. 7,918,622.

General Dynamics Portable Vehicle Arresting Barrier General Dynamics advertisement original date unknown. Publication date unknown—first cited to the USPTO on Jul. 22, 2008 in U.S. Pat. No. 7,918,622.

The Mifram Group Modular Vehicle Barrier posted on MiframSecurity.com original date unknown. Publication date unknown—first cited to the USPTO on Jul. 22, 2008 in U.S. Pat. No. 7,918,622.

The Mojo Barriers Mojo Steel Barrier posted on MojoBarriers.com original date unknown. Publication date unknown—first cited to the USPTO on Jul. 22, 2008 in U.S. Pat. No. 7,918,622.

Delta Scientific Corporation product specification for model DSC2000 Phalanx Barrier posted on Delta Scientific Website dated Oct. 11, 2006.

Carnahan Conference Paper Albuquerque New Mexico Oct. 2004 Presented by Nigel Buckley. Publication date unknown—first cited to the USPTO on Jul. 22, 2008 in U.S. Pat. No. 7,918,622.

International Search Report and Written Opinion dated Jul. 21, 2023, prepared in International Application No. PCT/US2023/020291.

International Search Report and Written Opinion dated Sep. 26, 2023, prepared in International Application No. PCT/US2023/027296.

International Search Report and Written Opinion dated Dec. 19, 2023 and prepared in PCT/US2023/020290.

Meridian Rapid Defense Group, Ventura CA Parade Protection. YouTube. Apr. 19, 2022. [Retrieved on Nov. 13, 2023]. Retrieved from internet: <URL: https://www.youtube.com/watch?v=0TFzLOVteBY>, entire video.

Meridian Rapid Defense Group, YouTube video titled "Deployment of Archer® 1200 Barriers with the V3 Hauler", published Mar. 13, 2019, https://www.youtube.com/watch?v=TveFiJVmvko.

Meridian Rapid Defense Group, YouTube video titled "Deployment of Meridian® Barriers with Air Tow Trailer", published Jan. 25, 2019, https://www.youtube.com/watch?v=qXQeYXeYVRc.

Australian Examination Report for Application No. 2023263404 mailed Sep. 12, 2025.

(56) References Cited

OTHER PUBLICATIONS

Australian Examination Report for Application No. 2023275395 mailed Sep. 19, 2025.
New Zealand Examination Report dated Apr. 20, 2026 for Application No. 815806.
New Zealand Examination Report dated Mar. 31, 2026 for Application No. 815805.

* cited by examiner

VEHICLE MITIGATION SYSTEM

CROSS-REFERENCE TO RELATED APPLICATIONS

This application claims the benefit of and priority to U.S. Provisional Application No. 63/336,288, filed on Apr. 28, 2022, which is hereby incorporated by reference in its entirety herein.

TECHNICAL FIELD

The present disclosure relates generally to the field of vehicle mitigation systems, and specifically to portable barriers capable of being rapidly deployed for protecting against vehicular and military style breaches.

BACKGROUND

Vehicle intrusions into restricted, protected or unwanted areas are troublesome due to the damage that can be caused, both in terms of property damage and injury or loss of life. There are many scenarios in which it is desired to restrict vehicular traffic in an area. Examples include road construction and other construction sites in order to protect construction workers and equipment. Others include high-profile or highly attended events like parades, sporting events, and political gatherings, where it is desired to keep unauthorized vehicles away from certain areas, especially those that have large gatherings of pedestrians. Still others include secure facilities such as military bases, governmental facilities or areas designated as restricted by law enforcement. While it is possible in some instances to install permanent barriers, many events or situations require that protection against vehicular intrusion be quickly provided and then removed following an event or situation calling for such protection.

BRIEF DESCRIPTION OF THE DRAWINGS

Illustrative examples of the present disclosure are described in detail below with reference to the attached drawing figures, which are incorporated by reference herein, and wherein.

Figure 1:
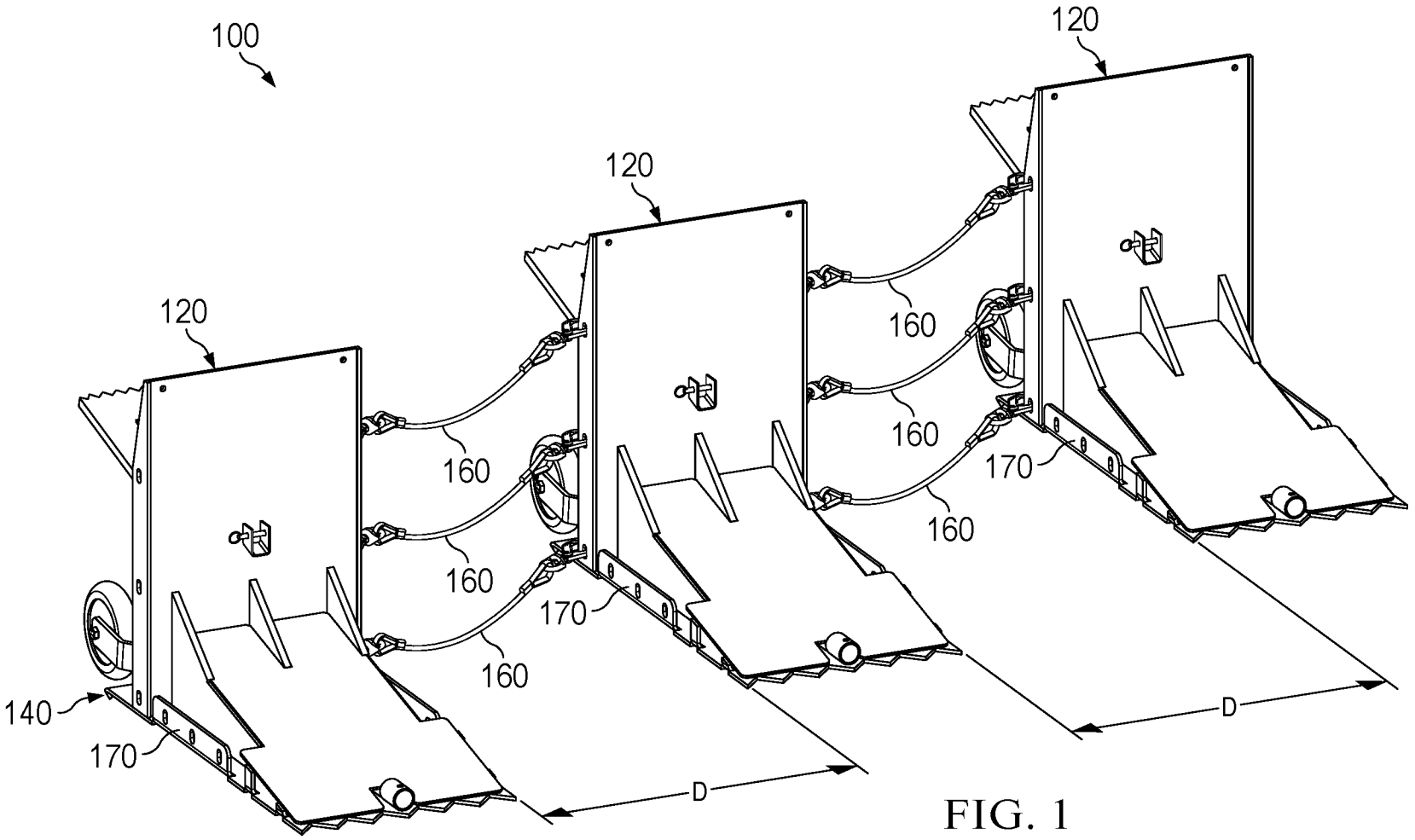
FIG. 1 is a front perspective view of a vehicle mitigation system in accordance with one or more examples described herein.

The illustrated figures are only exemplary and are not intended to assert or imply any limitation with regard to the environment, architecture, design, or process in which different examples may be implemented.

DETAILED DESCRIPTION

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The present disclosure relates generally to the field of vehicle mitigation systems, and specifically to portable barriers capable of rapid deployment for protecting against vehicular and military style breaches. A vehicle mitigation system is described herein that includes a plurality of portable barriers that are positioned near a perimeter defense area. The portable barriers are arranged such that a spacing distance is provided between the barriers, and the barriers may be connected by one or more arrestor cables that span the spacing distance between the barriers. Multiple configurations are described herein that use different numbers of barriers and different configurations of the arrestor cables to provide an effective barrier against vehicles and other traffic through areas of varying distance. Together, the barriers and arrestor cables are configured to absorb the kinetic energy of a vehicle as the vehicle contacts the vehicle mitigation system and the barriers move with the vehicle following contact.

The portability of the vehicle mitigation system allows the system to be quickly deployed to areas requiring defense against vehicles and other traffic. The barriers are transported using a trailer and may be deployed by a single user a wheeled hauler. After positioning the barrier, the user may easily connect one or more of the arrestor cables to the barriers to link the barriers together for additional protection. Although the arrestor cables may be made of any high tensile strength material, in one embodiment, the arrestor cable includes a multi-strand metallic cable such as a cable made from high-tensile-strength steel. The arrestor cable further may include a releasable attachment hook attached to each end of the multi-strand metallic cable, which allows the arrestor cable to be quickly and securely coupled to each barrier. The releasable attachment hooks further allow the arrestor cable to be selectively disconnected from the barriers to allow passage of vehicular or other traffic, or to allow movement and re-deployment of the barriers.

FIGS. 1-5 illustrate several views of a vehicle mitigation system 100 according to an illustrative embodiment. The vehicle mitigation system 100 includes three barriers 120 connected by arrestor cables 160. The system 100 is configured to slow or stop an offending (errant or breaching) vehicle in the event the vehicle passes into a perimeter defense area where the vehicle mitigation system 100 is deployed. The three connected barriers 120 are designed to surround the vehicle upon impact and drag the vehicle to a stop using the weight of the barriers, as well as teeth 140 provided at the base of the barriers 120 that dig into the road surface. The vehicle mitigation system 100 is easily seen in daylight as it comes in vibrant safety orange, safety yellow and lime green. The vehicle mitigation system 100 can also be deployed in low light conditions by utilizing high intensity prismatic decals located throughout the barrier to ensure the safety of the workers and drivers on the road. The high intensity prismatic decals can be seen 1000 feet away in nighttime conditions.

The vehicle mitigation system 100 is easy to install and requires no electricity, hydraulics or heavy machinery to move into place. The system 100 can be easily setup by one person and provide needed security to flaggers and workers in a matter of minutes. Removal of the system 100 is efficient and limits the amount of time a user needs to be in front of oncoming traffic. Further, the vehicle mitigation system 100 is time efficient, mobile and reusable. The vehicle mitigation system 100 is engineered to withstand multiple vehicle impacts without the need for any maintenance. The vehicle mitigation system 100 provides necessary safety to the workers and drivers alike.

Figure 2:
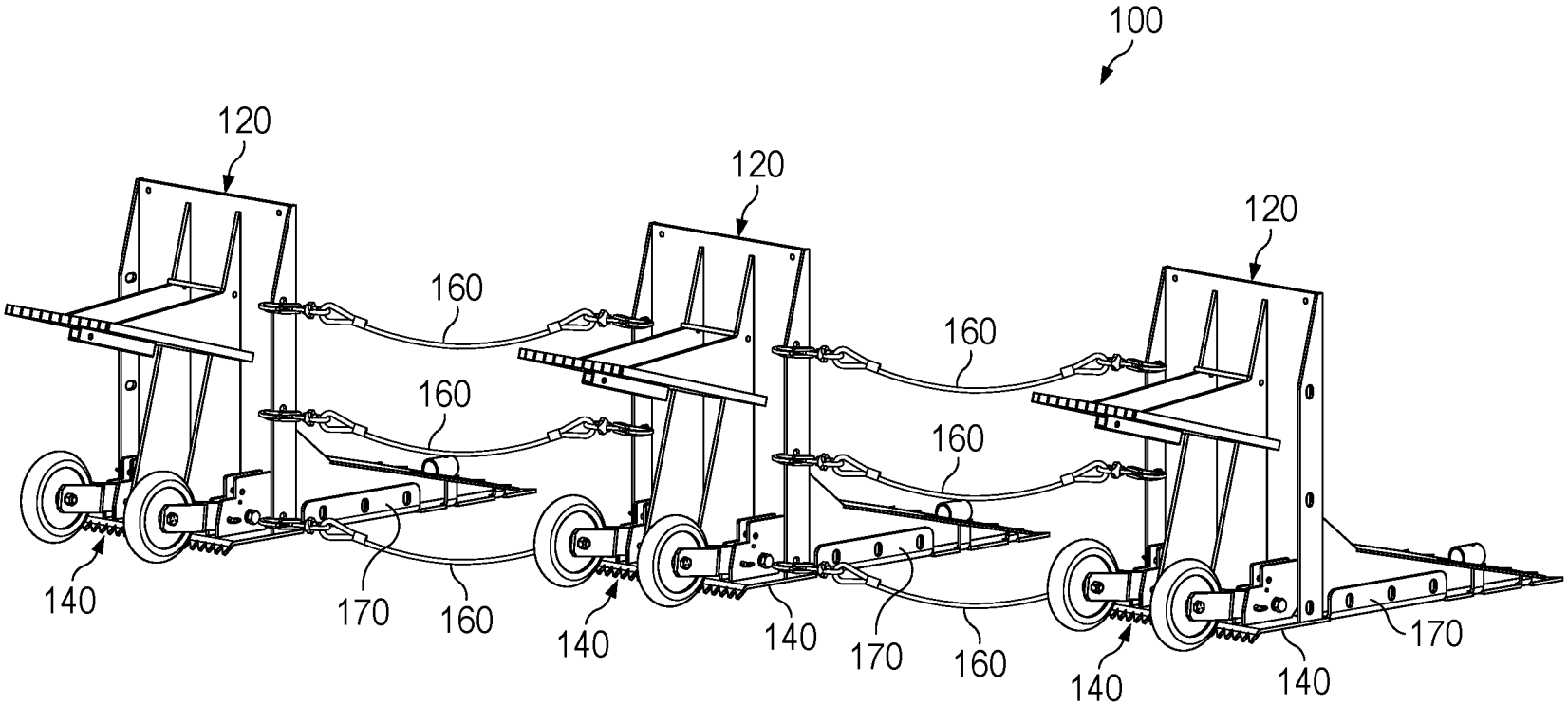
FIG. 2 is a rear perspective view of the vehicle mitigation system of FIG. 1.

Referring more specifically to FIGS. 1 and 2, while the vehicle mitigation system 100 may include at least two portable barriers 120, in the illustrated embodiment, three portable barriers 120 are provided and are positioned a spacing distance, D, apart from one another. At least one arrestor cable is provided to attach the barriers 120 to one another, and as illustrated, three arrestor cables 160 are attached between each of the barriers. The arrestor cables 160 may be attached at each end to a vertically-oriented plate 165 on the portable barriers 120. Alternatively, the arrestor cables 160 could be connected to a horizontally-oriented plate 170 on each barrier, or both the vertically-oriented plate 165 and horizontally-oriented plate 170. In the illustrated embodiment, the arrestor cables are vertically aligned with one another between the barriers. The arrestor cables are spaced apart such that a top arrestor cable is connected further up the barrier than an intermediate arrestor cable positioned below the top arrestor cable, but aligned with it in a vertical plane. The lowermost arrestor cable is attached below the intermediate arrestor cable, but also is substantially aligned in the vertical plane.

Figure 3:
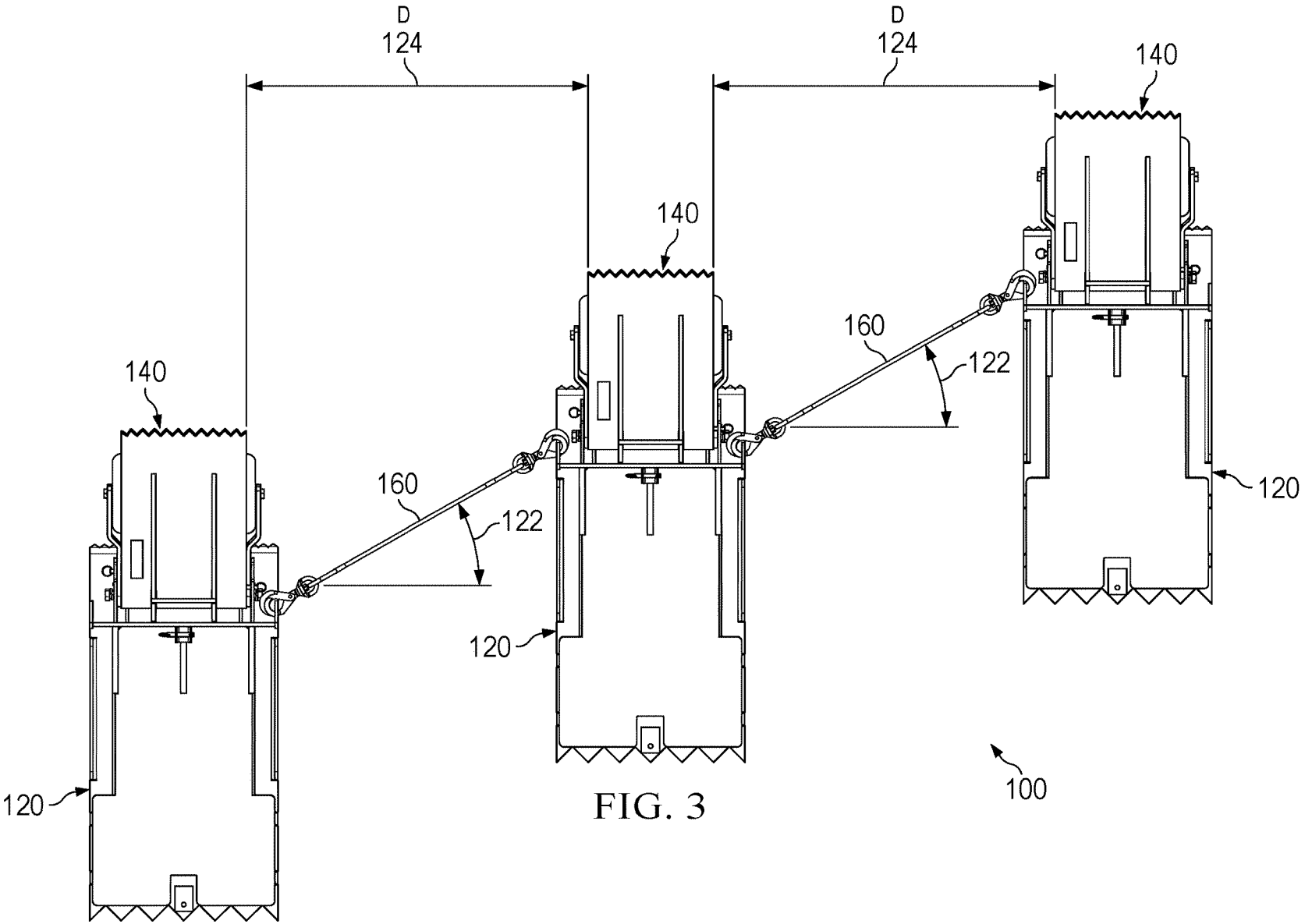
FIG. 3 is a top view of the vehicle mitigation system of FIG. 1.
Figure 4:
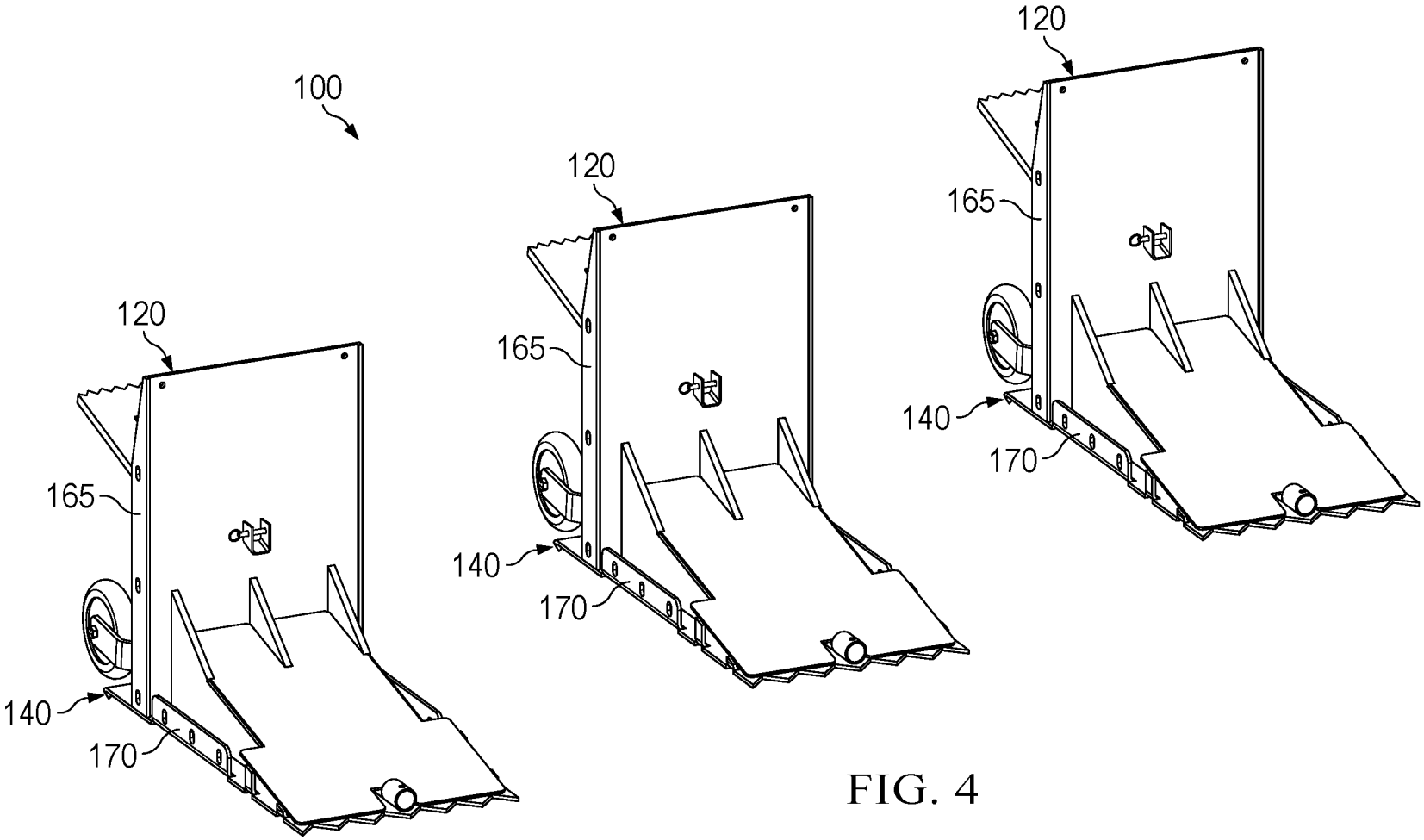
FIG. 4 is a front perspective view of the vehicle mitigation system of FIG. 1 illustrating an example of spacing between barriers.
Figure 5:
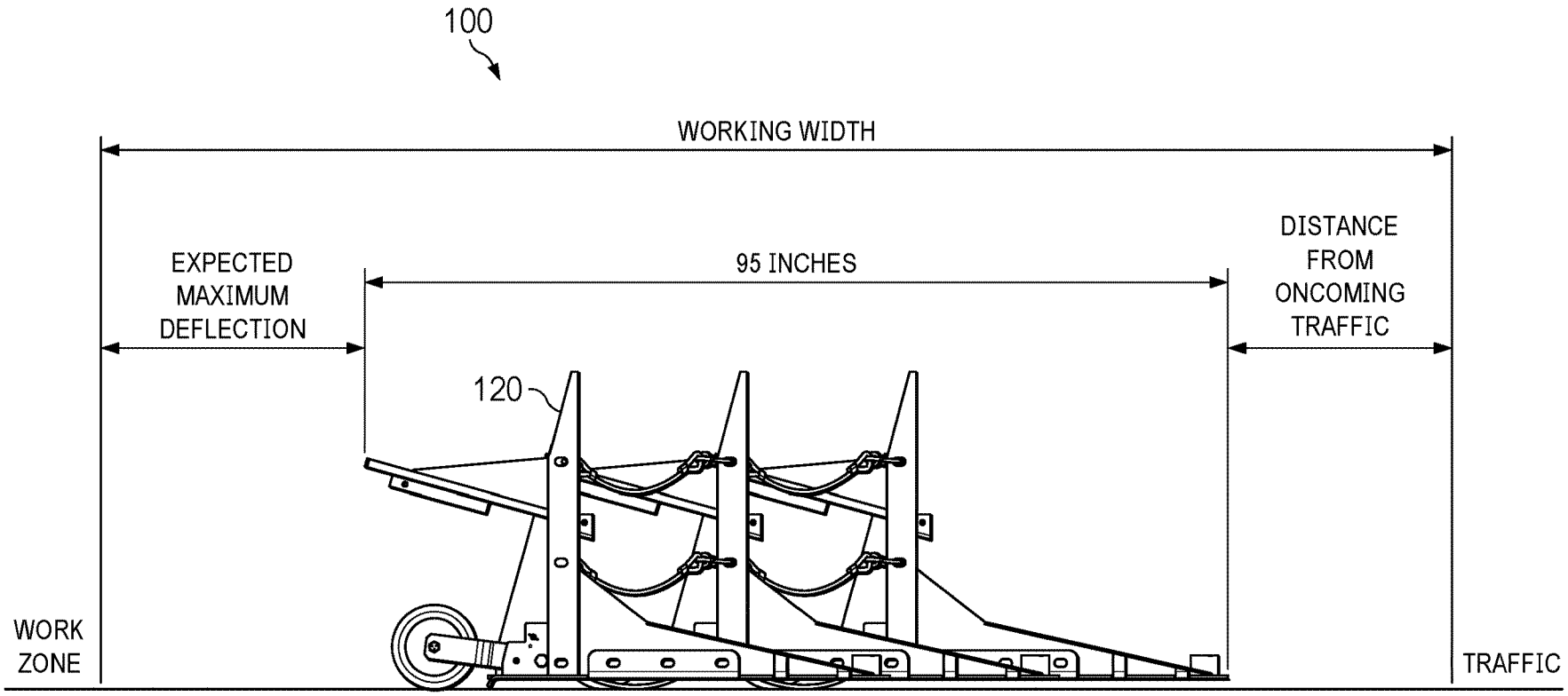
FIG. 5 is a side view of the vehicle mitigation system of FIG. 1 illustrating an example of spacing between barriers.

Referring more specifically to FIGS. 3-5, the deployment positions of the barriers 120 with respect to one another and in relation to a road and traffic are illustrated. The barriers 120 may be positioned at a predetermined angular separation 122 and a predetermined linear separation 124 with respect to each other. The minimum working width required for the vehicle mitigation system 100 is the total of the width of the barrier system 100 added to the expected deflection and the required distance from oncoming traffic. The expected deflection depends on the speed and slope of the road. The distance from oncoming traffic is determined by a taper distance created to route traffic to a different lane.

Figure 6:
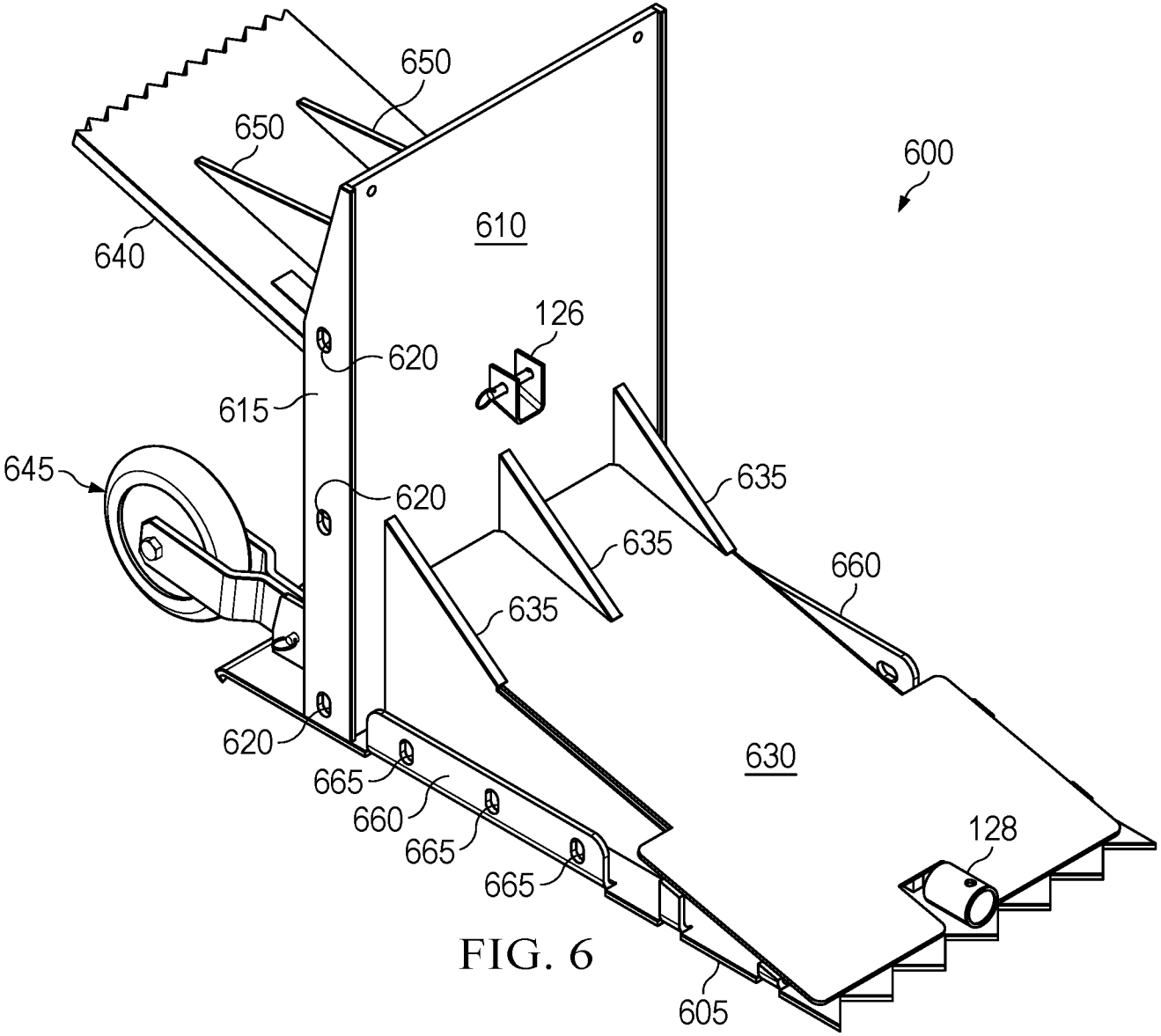
FIG. 6 is a front perspective view of a portable barrier in accordance with one or more examples described herein.
Figure 7:
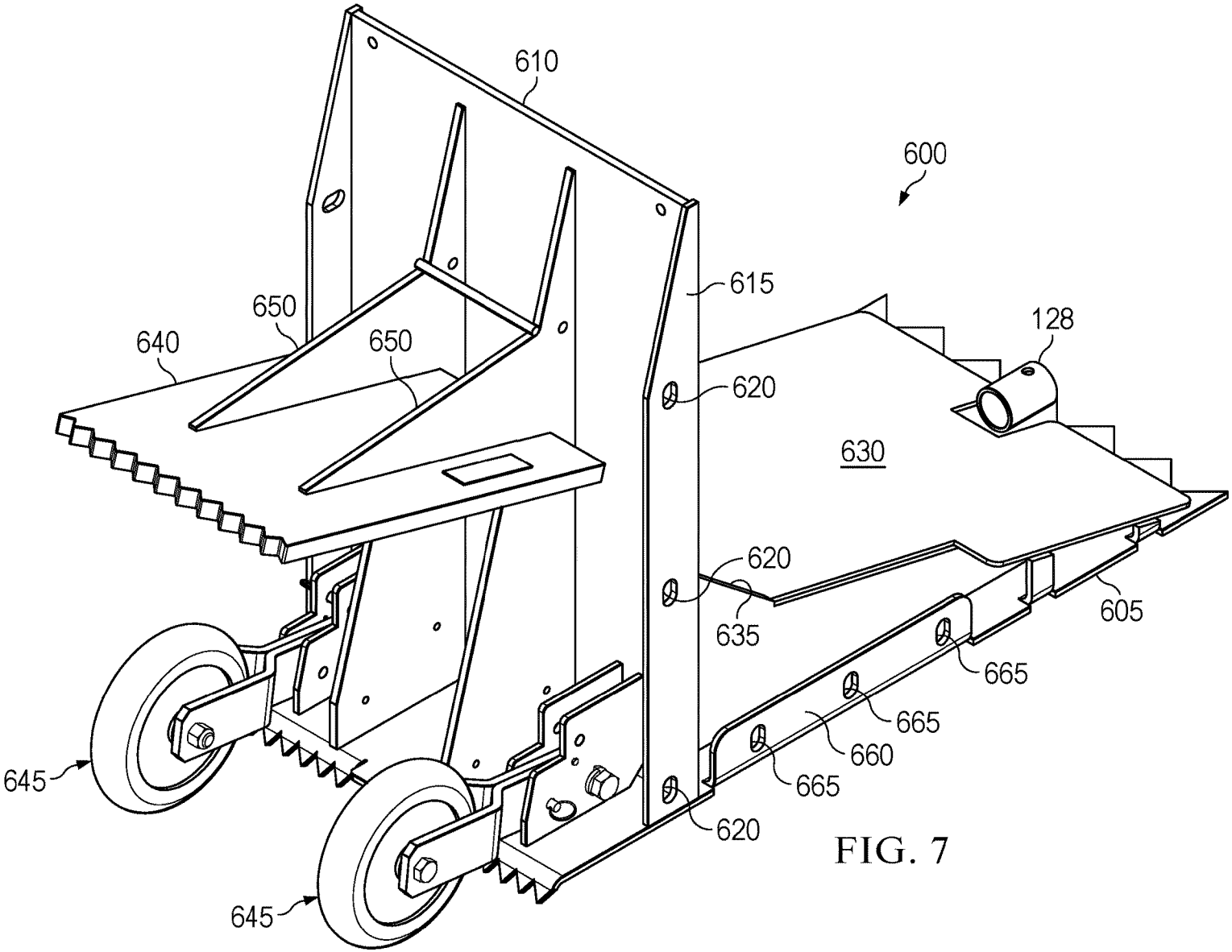
FIG. 7 is a rear perspective view of the portable barrier of FIG. 6.

FIGS. 6 and 7 illustrate perspective views of a portable barrier 600 that may be deployed as part of the vehicle mitigation systems described herein. Portable barrier 600 is a generally L-shaped modular barrier 600 that includes a base plate 605 for supporting the modular barrier on a surface and an upwardly extending front plate 610 for receiving impact forces and for providing munitions protection. The base plate 605 includes vertically-oriented side plates 615 having apertures 620. A ramp 630 is provided on a first side of the front plate 610 and supported by a plurality of gussets 635. Portable barrier 600 also includes a kick plate 640 positioned on a second side of the front plate 610. A wheel assembly 645 is positioned beneath the kick plate 640, and the wheels of the wheel assembly are extendable into a transport position to allow transport of the portable barrier 600. A plurality of gusset reinforcements 650 are provided on the second side of the front plate 610 to support the kick plate 640. A horizontally-oriented side plate 660 is provided along the base plate 605 along each edge of the base plate. Similar to the vertically-oriented side plates 615, the horizontally-oriented side plates 660 include apertures 665. The apertures 620 and 665 allow for attachment of the arrestor cables of the vehicle mitigation system.

Figure 8:
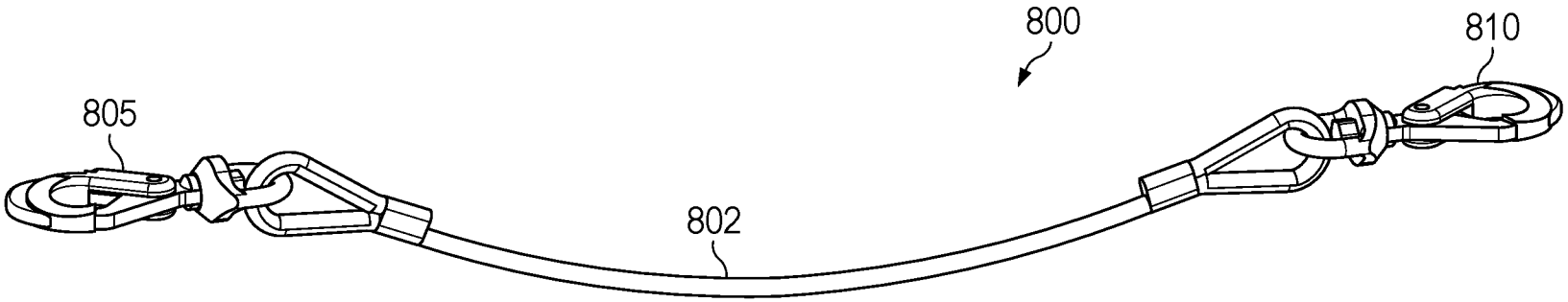
FIG. 8 is a front perspective view of an arrestor cable in accordance with one or more examples described herein.

FIG. 8 illustrates a perspective view of an arrestor cable 800 that may be deployed as part of the vehicle mitigation systems described herein. The arrestor cable 800 is meant to tether at least two portable barriers together to improve the slowing or stopping capabilities of the vehicle mitigation system, and also to broaden the coverage of the portable barriers without requiring a solid line of barriers to be deployed. The arrestor cable also allows for the quick deployment of the vehicle mitigation system and allows authorized users to selectively provide access to vehicles or other traffic (e.g. pedestrians) between tethered barriers.

Figure 9:
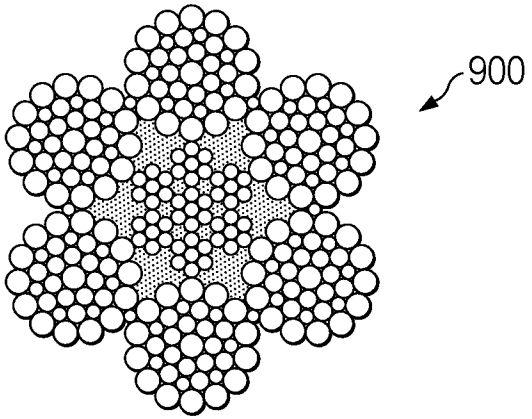
FIG. 9 is a cross-sectional side view of an arrestor cable in accordance with one or more examples described herein.

The arrestor cable in one embodiment may include a high-tensile strength cable 802 that is capable of attaching two barriers. Quick attachment devices such as a first releasable attachment hook 805 and a second releasable attachment hook 810 may be attached to each end of the high-tensile strength cable. Referring to FIG. 9, in one embodiment, the cable may include a multi-strand metallic cable 900, which is illustrated in cross-section. This multi-strand metallic cable may be constructed from individual strands of steel, another metal, or an alloy of two or more metals. The cable may or may not have a protective sheath around an exterior of the cable to protect users of the cable and pedestrians that may come into contact with the cable.

Figure 10:
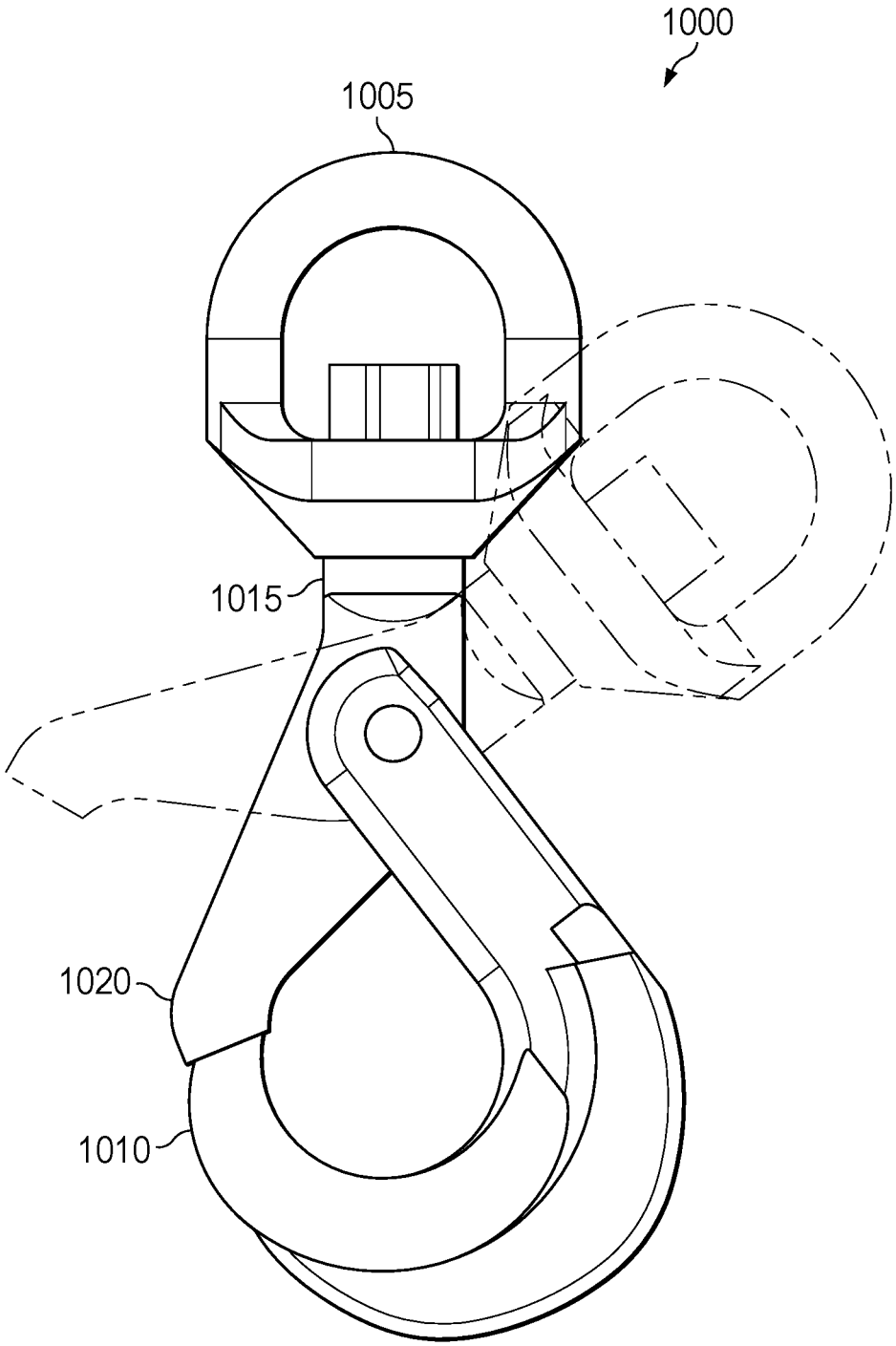
FIG. 10 is a front view of a releasable attachment hook in accordance with one or more examples described herein.

FIG. 10 illustrates a front view of a releasable attachment hook 1000 similar to the first and releasable attachment hooks 805, 810 that are part of arrestor cable 800. The releasable attachment hook 1000 includes an attachment ring 1005 and a hook 1010. The hook 1010 is rotatably joined to the attachment ring 1005 by a pin 1015 that allows the hook 1010 to swivel about an axis of the pin 1015 relative to the attachment ring 1005. The hook 1010 includes a securement clasp 1020 that may be spring biased to urge the securement clasp 1020 into a closed position to prevent inadvertent disengagement from one of the barriers. All of the components of the releasable attachment hook 1000 are preferably made from a metal or other high-tensile strength material to minimize or prevent failure of the releasable attachment hook 1000 when exposed to forces resulting from the impact of a vehicle with the vehicle mitigation system.

FIGS. 11-15 depict multiple configurations of vehicle mitigation systems. In each vehicle mitigation system, the number and arrangement of barriers and arrestor cables is varied to provide systems that improve the mitigating effects for different site scenarios. As an example, some of the configurations maximize the width of protection while still providing maximum access to pedestrians.

Figure 11A:
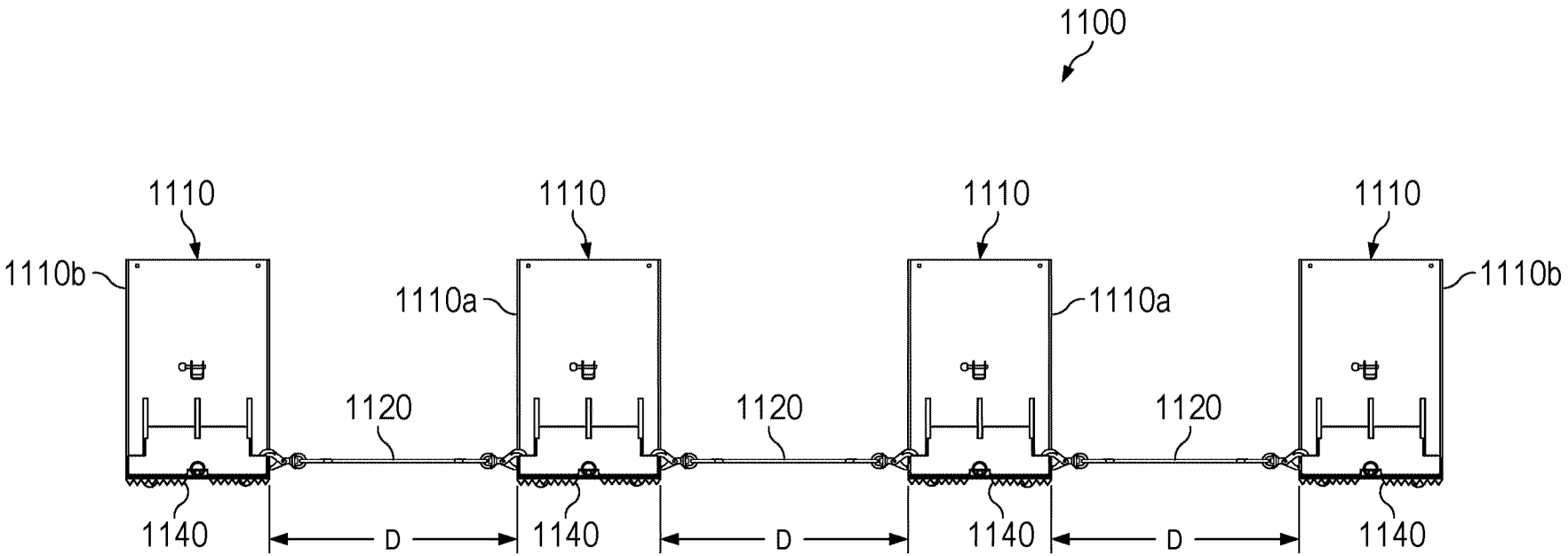
FIGS. 11A and 11B are front and top views, respectively, of a vehicle mitigation system in accordance with one or more examples described herein.
Figure 11B:
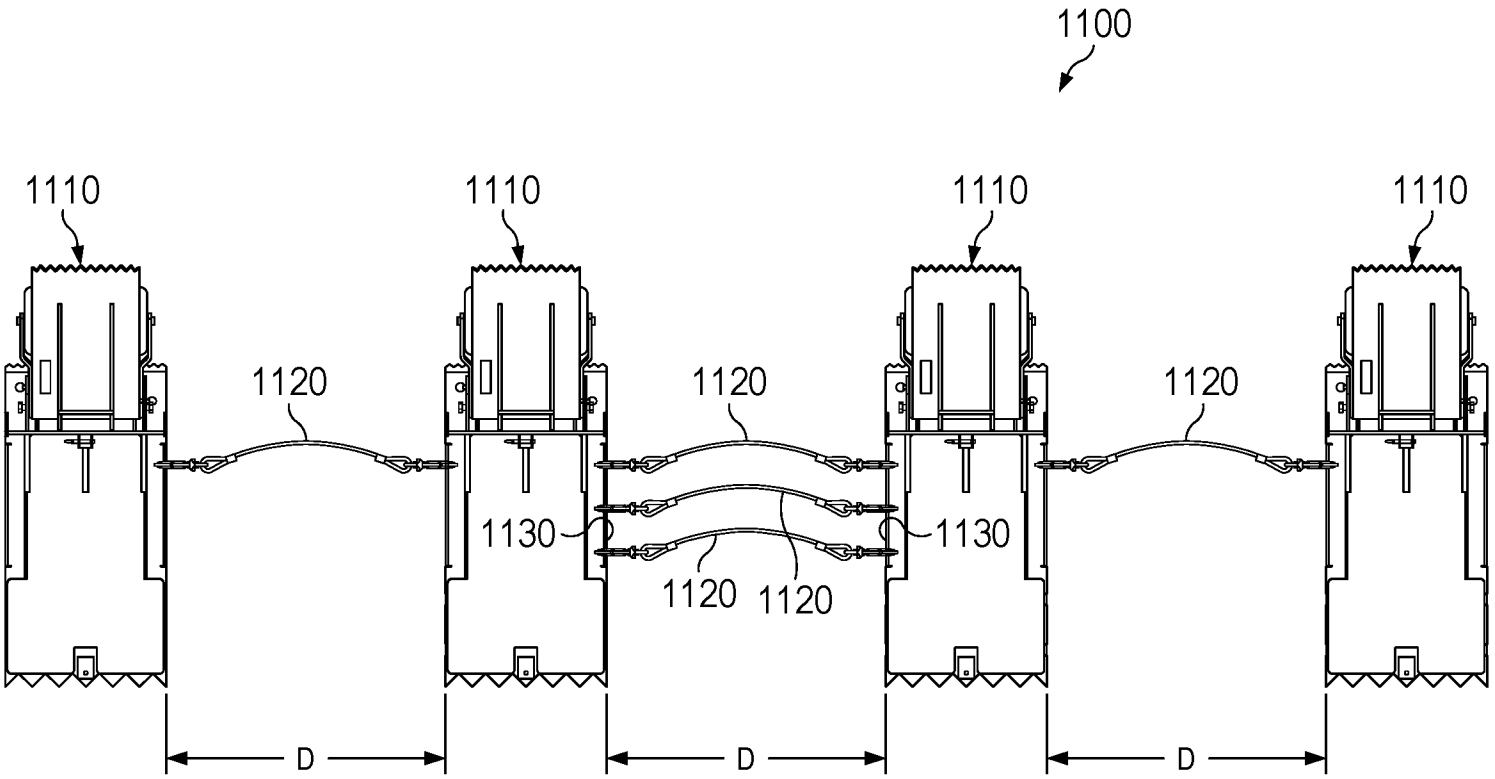

Referring more specifically to FIGS. 11A and 11B, a vehicle mitigation system 1100 is illustrated in front (FIG. 11A) and top (FIG. 11B) views. Vehicle mitigation system 1100 includes four portable barriers 1110, each barrier deployed and arranged a spacing distance D away from the adjacent barrier. In the embodiment illustrated, the spacing distance D is approximately 48 inches. The inner portable barriers 1110*a* are connected to one another by three arrestor cables 1120. According to at least one embodiment, the arrestor cables 1120 are configured similarly to arrestor cable 800 of FIG. 8 with releasable attachment hooks. Each arrestor cable 1120 is attached to a horizontally-oriented plate 1130 of the inner portable barriers 1110*a*. The horizontally-oriented plate 1130 in one embodiment may be attached to the base plate 1140 of the barriers 1110, but alternatively, the horizontally-oriented plate 1130 may be an integral part of the base plate 1140. The three arrestor cables are horizontally aligned such that the three cables are substantially within a horizontal plane near the surface or ground on which the barriers sit. In either example, connection of the arrestors cables in this configuration allows the arrestor cables to be situated very close to the ground on which the barriers 1110 are deployed, which improves access for pedestrians walking between the barriers 1110.

Outer barriers 1110*b* are arranged outside of the inner barriers 1110*a*, and each outer barrier 1110*b* is attached by at least one arrestor cable 1150 to one of the inner barriers 1110*a*. Again, the arrestor cable is attached to a horizontally-oriented plate 1130 of the barriers to minimize the possibility of a pedestrian tripping over the arrestor cable 1150.

Figure 12A:
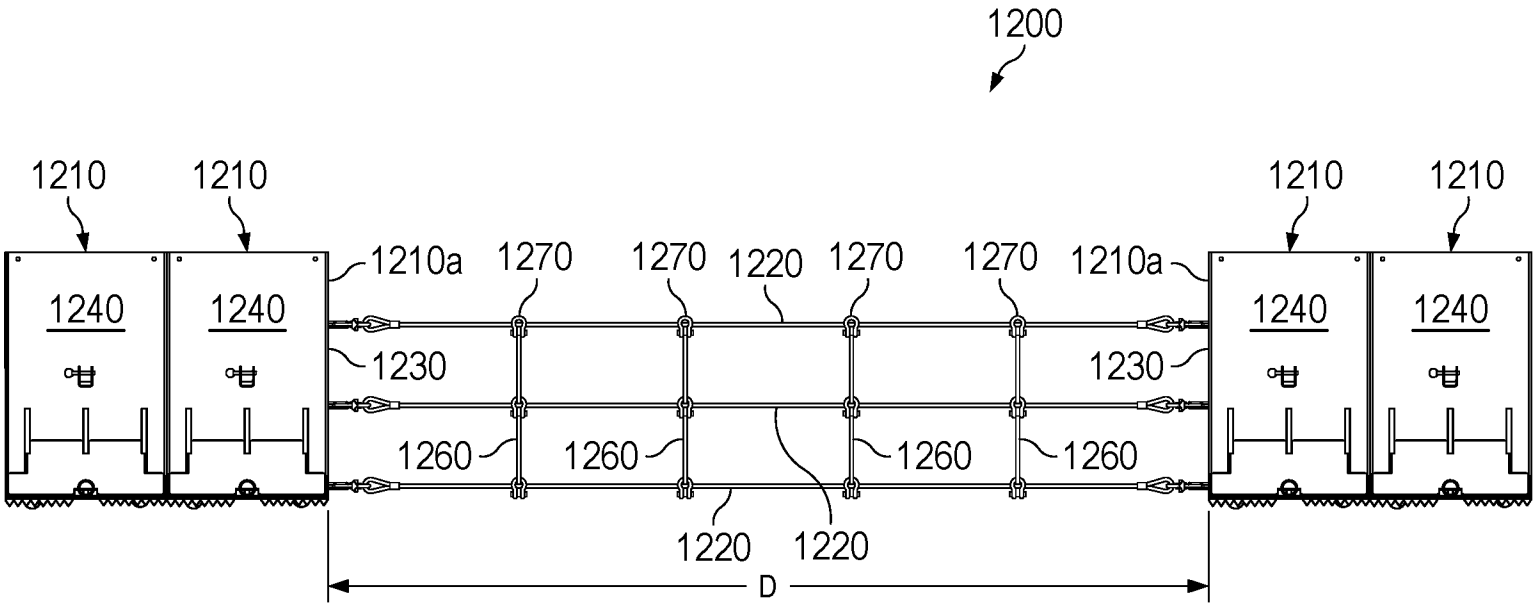
FIGS. 12A and 12B are front and top views, respectively, of a vehicle mitigation system in accordance with one or more examples described herein.
Figure 12B:
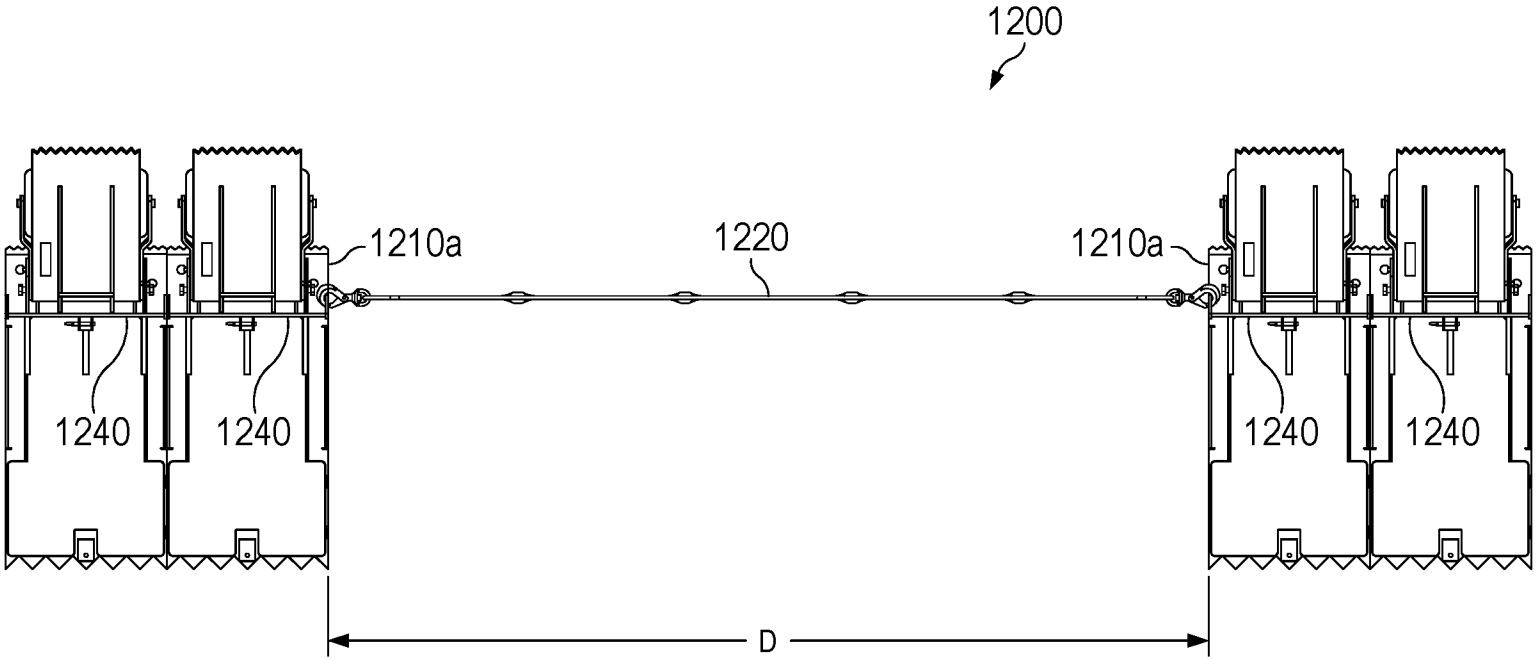

Referring more specifically to FIGS. 12A and 12B, a vehicle mitigation system 1200 is illustrated in front (FIG. 12A) and top (FIG. 12B) views. Vehicle mitigation system 1200 includes four portable barriers 1210 arranged in pairs on each side of an opening that spans a spacing distance D. Each pair of portable barriers 1210 is rigidly connected to one another. In the example illustrated, bolts (not shown) are used to connect the barriers 1210 through apertures in horizontally and vertically-oriented plates. By pairing the barriers 1210, additional weight is added to each side of the opening, which allows the spacing distance D to be larger than other configurations. In the embodiment of FIGS. 12A and 12B, the spacing distance is approximately 120 inches.

Arrestor cables 1220 are connected to the inner barrier 1210*a* of each pair. Three arrestor cables 1220 are connected between each of the inner barriers 1210*a*. According to at least one embodiment, the arrestor cables 1220 are configured similarly to arrestor cable 800 of FIG. 8 with releasable attachment hooks. Each arrestor cable 1220 is attached to a vertically-oriented plate 1230 of the inner barriers 1210*a*. The vertically-oriented plate 1230 in one embodiment may be attached to the front plate 1240 of the barriers 1210, but alternatively, the vertically-oriented plate 1230 may be an integral part of the front plate 1240. In the illustrated embodiment, the arrestor cables are vertically aligned with one another between the barriers. The arrestor cables are spaced apart such that a top arrestor cable is connected further up the barrier than an intermediate arrestor cable positioned below the top arrestor cable, but aligned with it in a vertical plane. The lowermost arrestor cable is attached below the intermediate arrestor cable, but also is aligned in the vertical plane.

Since the span of the arrestor cables is somewhat longer than other configurations, a plurality of vertical arrestor cables 1260 are coupled to the arrestor cables 1220 between the inner barriers 1210*a*. The vertical arrestor cables 1260 add additional resistance to deflection of the longer, horizontal arrestor cables 1220, which improves the slowing or stopping ability of the vehicle mitigation system. The vertical arrestor cables 1220 may include a pin shackle 1270 at each end of a cable to allow connection to the horizontal arrestor cables 1220. Like the releasable attachment hooks, the pin shackle 1270 used for each vertical arrestor cable 1220 is made from metal or another high-strength material. The combination of vertical and horizontal arrestor cables forms a cable net that may be disconnected at either end from the inner barriers 1210*a* to allow authorized vehicle or other traffic to pass between the portable barriers 1210.

Figure 13A:
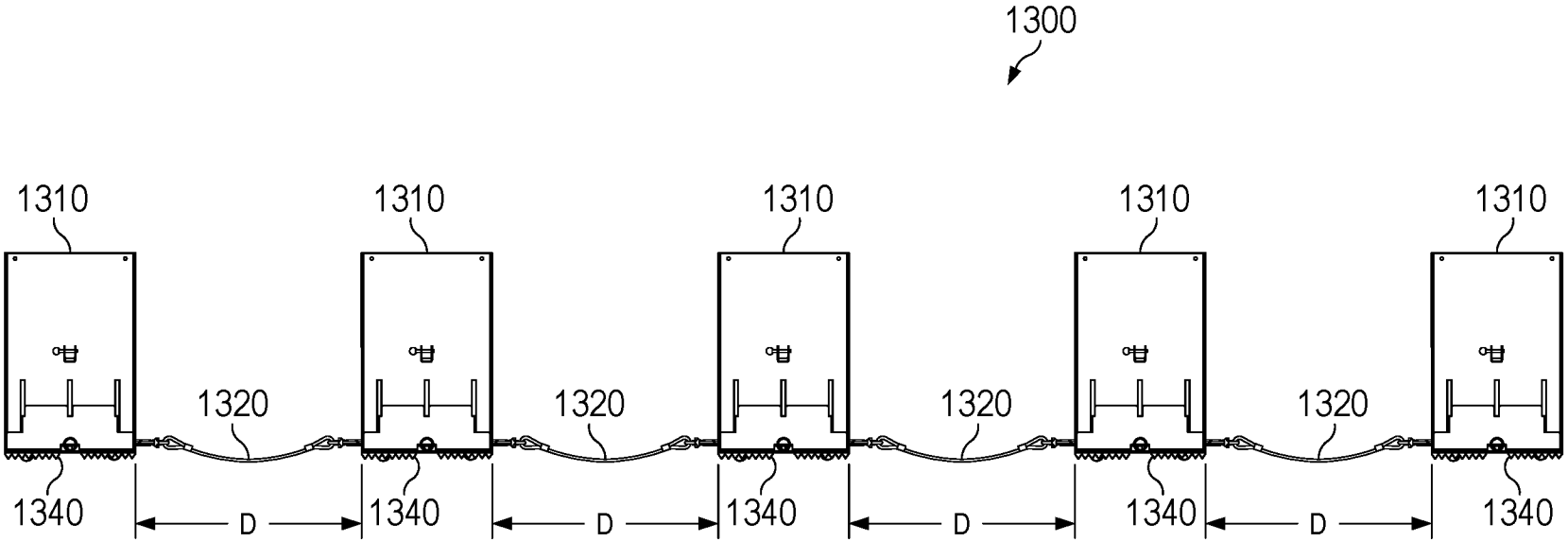
FIGS. 13A and 13B are front and top views, respectively, of a vehicle mitigation system in accordance with one or more examples described herein.
Figure 13B:
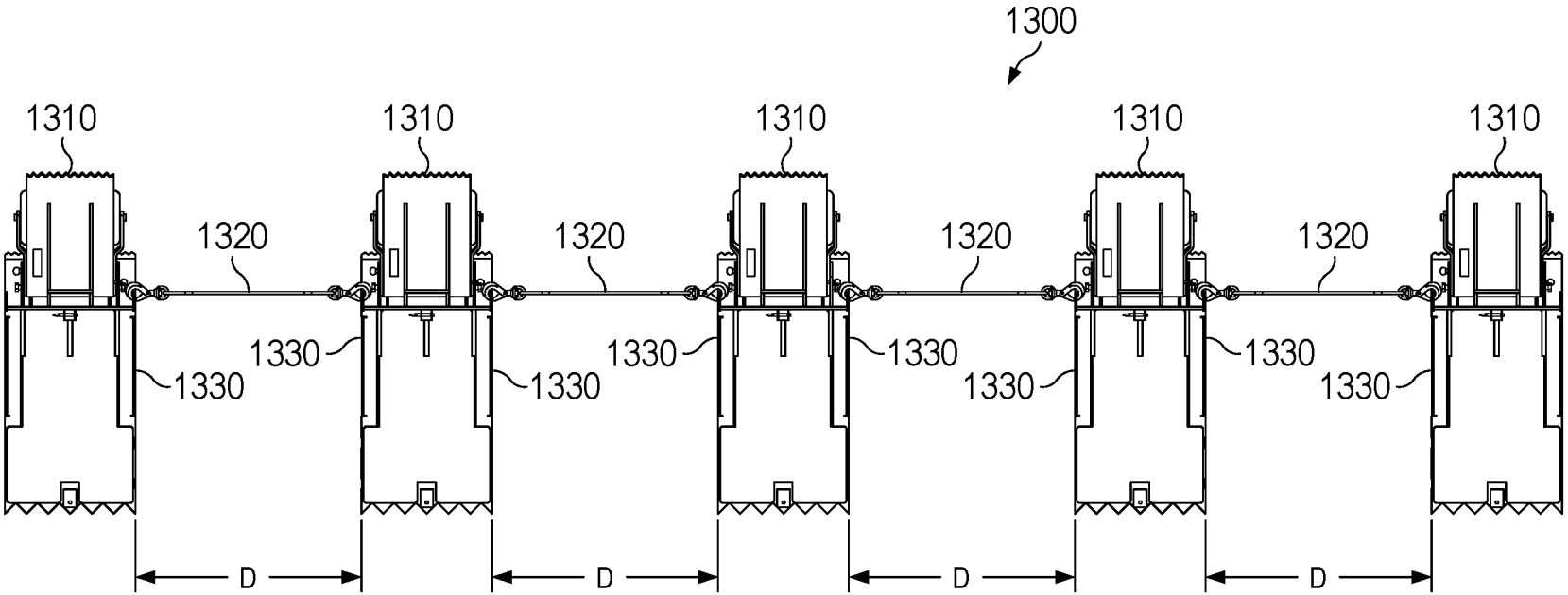

Referring more specifically to FIGS. 13A and 13B, a vehicle mitigation system 1300 is illustrated. A front view of the vehicle mitigation system 1300 is depicted in FIG. 13A, and a top view in FIG. 13B. Vehicle mitigation system 1300 includes five portable barriers 1310, each barrier deployed and arranged a spacing distance D away from the adjacent barrier. In the embodiment illustrated, the spacing distance D is 48 inches. All of the barriers 1310 are equally spaced, and each barrier 1310 is connected to an adjacent barrier by a single arrestor cable 1320. According to at least one embodiment, the arrestor cables 1320 are configured similarly to arrestor cable 800 of FIG. 8 with releasable attachment hooks. Each arrestor cable 1320 is attached to a horinzontally-oriented plate 1330 of the portable barriers 1310 or to a plate near the ground on which the barrier is sitting. The horizontally-oriented plate 1330 in one embodiment may be attached to the base plate 1340 of the barriers 1310, but alternatively, the horizontally-oriented plate 1330 may be an integral part of the base plate 1340. In either example, connection of the arrestors cables in this configuration allows the arrestor cables to be situated very close to the ground on which the barriers 1310 are deployed, which allows access for pedestrians walking between the barriers 1310.

Compared to the vehicle mitigation system 1100 of FIGS. 11A and 11B, the vehicle mitigation system 1300 provides a wider footprint of protection. Fewer arrestor cables 1320 are used since more portable barriers 1310 are used. The addition of portable barriers, especially when all linked by arrestor cables 1320, increases the weight and thus the slowing or stopping ability of the vehicle mitigation system 1300.

Figure 14A:
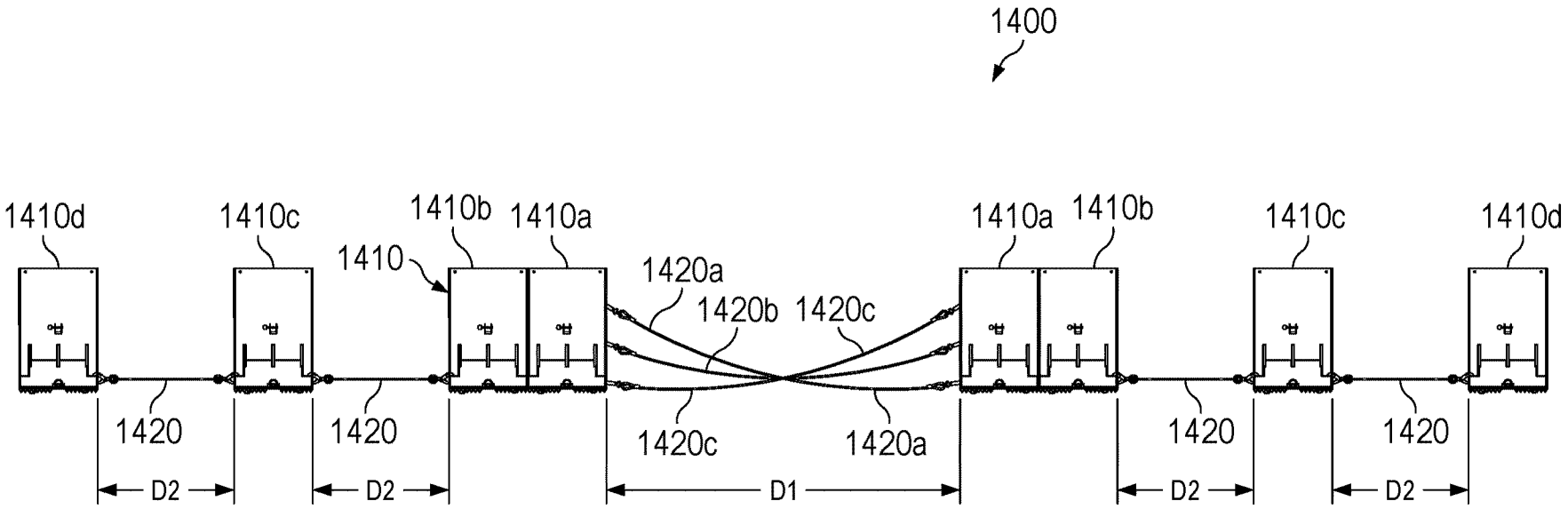
FIGS. 14A and 14B are front and top views, respectively, of a vehicle mitigation system in accordance with one or more examples described herein.
Figure 14B:
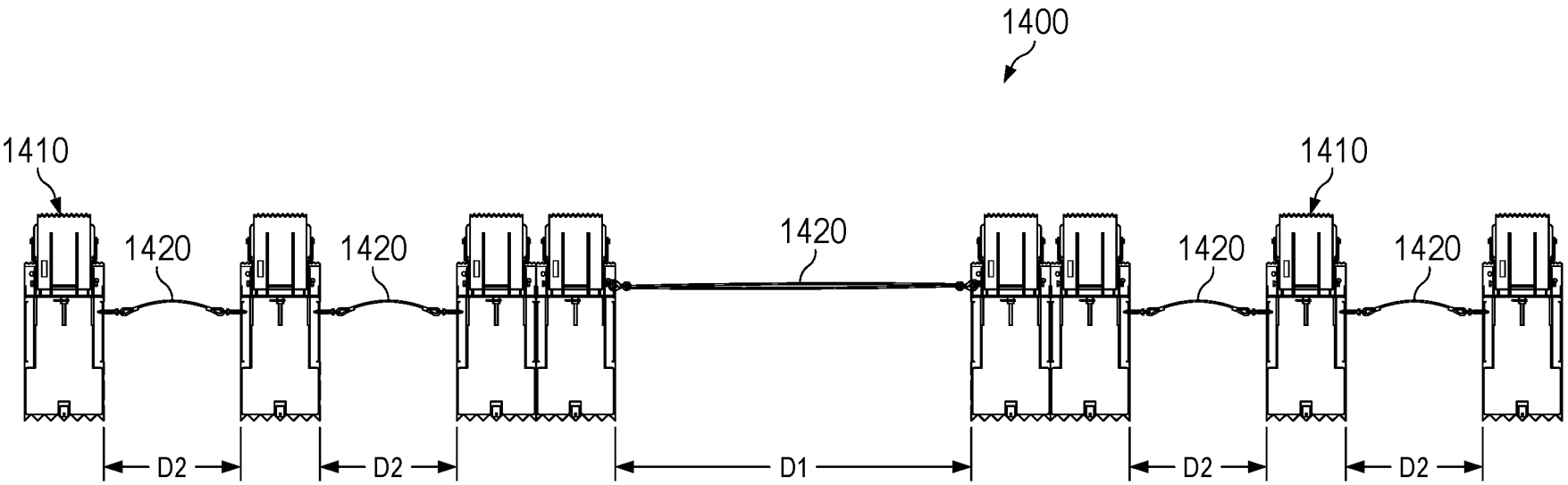

Referring more specifically to FIGS. 14A and 14B, a vehicle mitigation system 1400 is illustrated in front (FIG. 14A) and top (FIG. 14B) views. Vehicle mitigation system 1400 provides an ultra-wide footprint and provides extended security across large openings or pathways. A total of eight portable barriers 1410 is provided. Each of the innermost barriers 1410*a* is rigidly joined to an adjacent barrier 1410*b* in a manner similar to the configuration described in FIGS. 12A and 12B. These barrier pairs each sit on either side of a large opening having a spacing distance of D1. In the embodiment illustrated, this distance is 120 inches, although other distances could be arranged. While the cable net configuration of FIGS. 12A and 12B could be used with the present configuration, an alternative arrangement is illustrated in FIG. 14A in which three arrestor cables 1420*a*, 1420*b*, and 1420*c* are attached between vertically-oriented plates of the innermost barriers 1410*a*. The arrestor cables 1420*a* and 1420*c* are arranged in a crossed configuration in which the cables cross one another. As an example, arrestor cable 1420*a* may be connected to a higher aperture on the vertically-oriented plate of one of the barriers 1410*a* than the aperture on the plate of the other of the barriers 1410*a*. When a similar connection is made for arrestor cable 1420*c*, the cables 1420*a*, 1420*c* cross one another. In the illustrated embodiment, the arrestor cables are substantially vertically aligned with one another between the barriers. The arrestor cables are spaced apart such that a top arrestor cable is connected further up the barrier than an intermediate arrestor cable positioned below the top arrestor cable, but substantially aligned with it in a vertical plane. The lowermost arrestor cable is attached below the intermediate arrestor cable, but also is substantially aligned in the vertical plane. The vehicle mitigation system 1400 also includes an intermediate barrier 1410*c* and an outer barrier 1410*d* positioned outboard of the two pairs of barriers. Each intermediate barrier 1410*c* is arranged a spacing distance D2 from the barrier 1410*b*, and each outer barrier 1410*d* is arranged the same spacing distance D2 from the intermediate barrier 1410*c*. In the illustrated embodiment, spacing distance D2 is approximately 48 inches.

Each intermediate barrier 1410*c* is connected to one of the barriers 1410*b* by a single arrestor cable 1420. Similarly, each outer barrier 1410*d* is connected to one of the intermediate barriers 1410*c* by a single arrestor cable 1420, In one embodiment, the arrestor cables 1420 are configured similarly to arrestor cable 800 of FIG. 8 with releasable attachment hooks. Each arrestor cable 1420 is attached to a horizontally-oriented plate of the portable barriers 1410 or near the ground. The horizontally-oriented plate in one embodiment may be attached to the base plate of the barriers 1410, but alternatively, the horizontally-oriented plate may be an integral part of the base plate. In either example, connection of the arrestors cables in this configuration allows the arrestor cables to be situated very close to the ground on which the barriers 1410 are deployed, which allows access for pedestrians walking between the barriers 1410 without removing any of the arrestor cables 1420*a-c* spanning the greater opening.

Figure 15A:
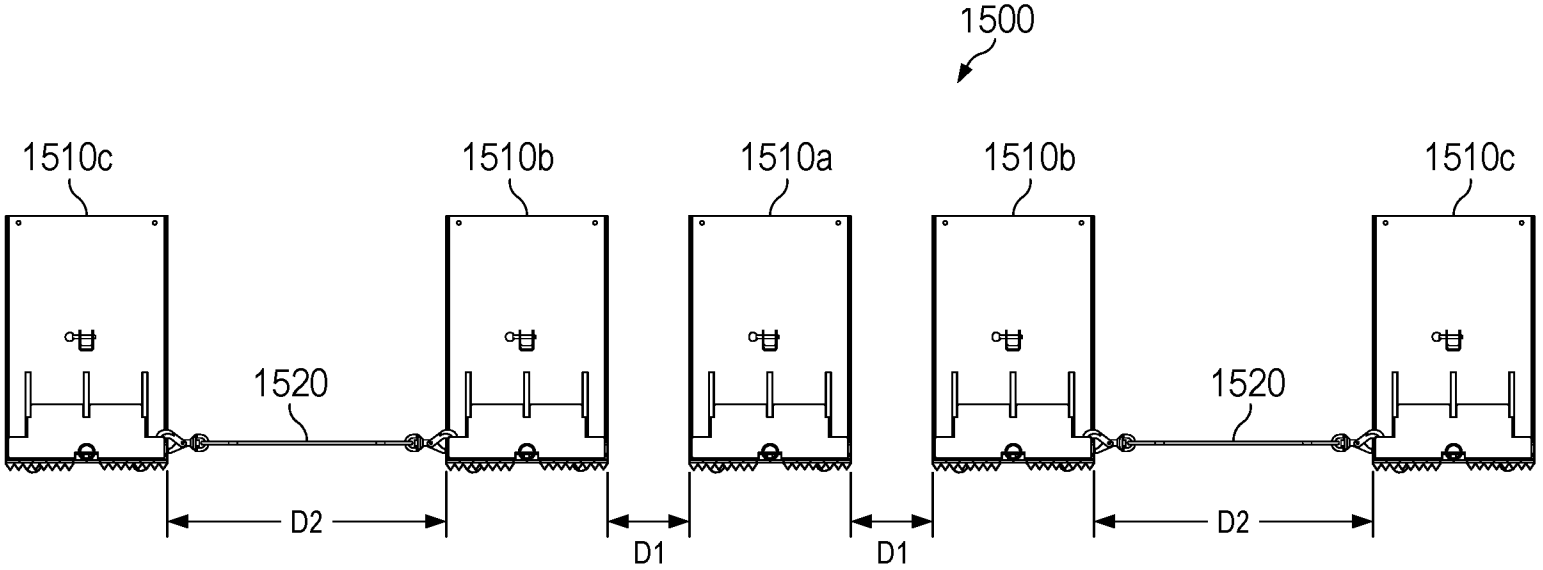
FIGS. 15A and 15B are front and top views, respectively, of a vehicle mitigation system in accordance with one or more examples described herein.
Figure 15B:
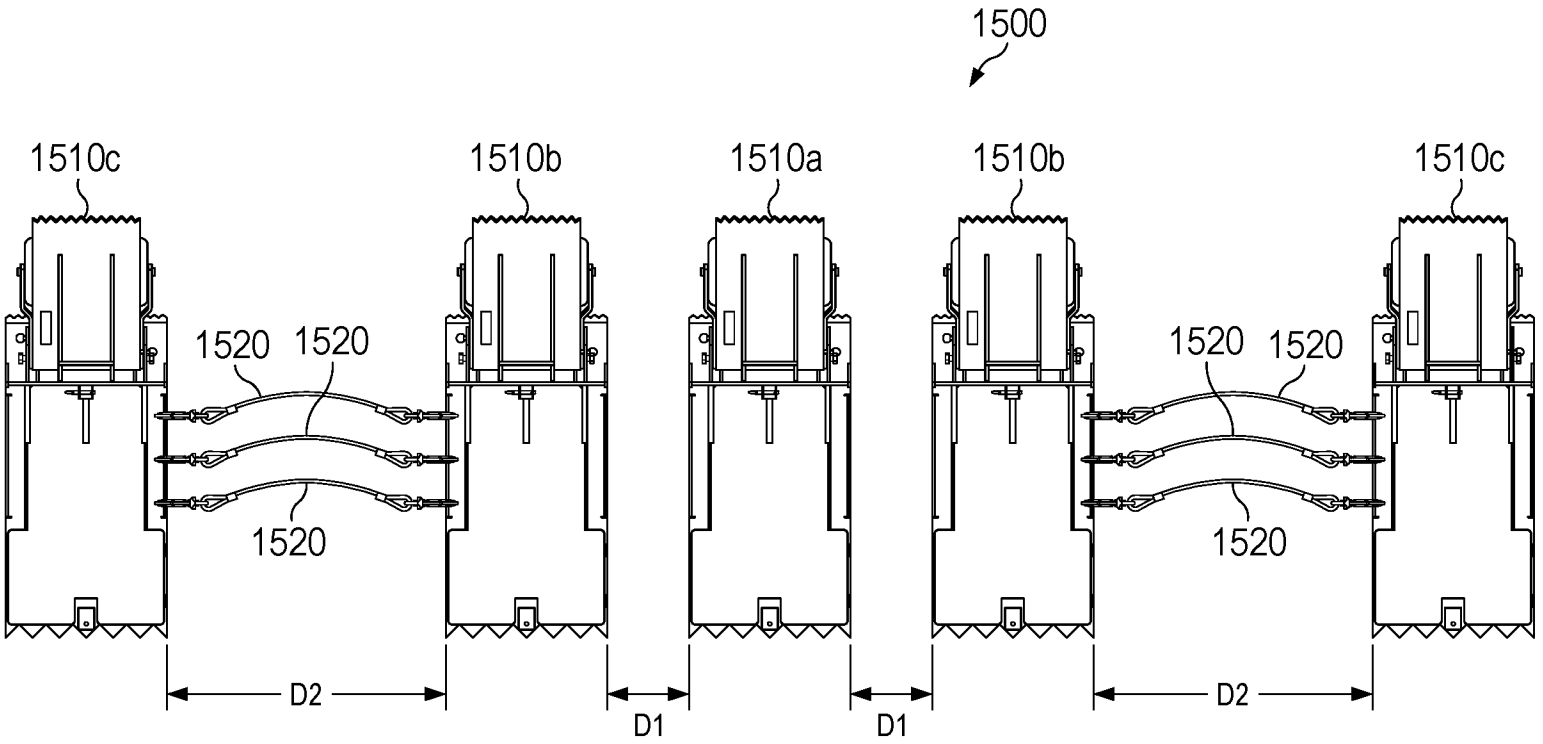

Referring more specifically to FIGS. 15A and 15B, a vehicle mitigation system 1500 is illustrated in front (FIG. 15A) and top (FIG. 15B) views. Vehicle mitigation system 1500 includes five portable barriers 1510. In the embodiment illustrated, a central barrier 1510*a* is positioned in a center of the pathway that is being protected. The central barrier 1510*a* stands alone and is not connected to adjacent barriers. An intermediate barrier 1510*b* is positioned on each side of the central barrier 1510*a* and is spaced apart a spacing distance D1 from central barrier 1510*a*. The spacing distance D1 in the illustrated embodiment is approximately 12 inches. An outer barrier 1510*c* is positioned adjacent each intermediate barrier 1510*b* and is spaced apart a spacing distance D2 from the intermediate barrier 1510*b*. The spacing distance D2 in the illustrated embodiment is approximately 48 inches. Each of the outer barriers 1510*c* are connected to the adjacent intermediate barrier 1510*b* by three arrestor cables 1520. According to at least one embodiment, the arrestor cables 1520 are configured similarly to arrestor cable 800 of FIG. 8 with releasable attachment hooks. Each arrestor cable 1520 is attached to a horizontally-oriented plate on the outer barriers 1510*c* and intermediate barriers 1510*b*. The three arrestor cables are horizontally aligned such that the three cables are substantially within a horizontal plane near the surface or ground on which the barriers sit. Again, connection of the arrestors cables in this configuration allows the arrestor cables to be situated very close to the ground on which the barriers 1510 are deployed, which improves access for pedestrians walking between the barriers 1510.

Testing was performed according to ASTM F2656-20 on the barrier configurations and examples illustrated in FIGS. 11-15. Vehicle penetration distances were determined for vehicles of various weights with an impact speed of approximately 30 mph. Data for each configuration is provided below in Table 1:

TABLE 1

Impact Test Data

| Configuration | Vehicle Type | Vehicle Weight (lbs/kg) | Impact Speed (mph/kph) | Penetration Distance (ft/m) |
|---|---|---|---|---|
| FIG. 11 | Full sized sedan | 4630 [2100] | 31.0 [49.9] | P2 < 18 [5.4] |
| FIG. 12 | Full sized sedan | 2480 [1125] | 31.2 [50.2] | P2 < 20 |
| FIG. 13 | Full sized sedan | 2341 [1062] | 31.0 [49.9] | P2 < 15 [4.5] |
| FIG. 14 | Full sized sedan | 2519 [1143] | 30.0 [48.2] | P2 < 19 [5.8] |
| FIG. 15 | Full sized sedan | 3413 [1548] | 31.2 [50.2] | P2 < 13 [3.9] |

In one exemplary application, the vehicle mitigation systems described herein may be deployed in a construction zone. In another exemplary application, the vehicle mitigation systems may be deployed in an overhead powerline construction site. In another exemplary application, the vehicle mitigation systems may be deployed at a manhole construction site. The vehicle mitigation systems may be used in typical traffic management applications for several scenarios including events, bridge construction, diversions, detours, road closures, lane closures, protective security, mass gatherings, building sites, mines, parks and sportsgrounds and road maintenance.

In addition to the embodiments and examples of a vehicle mitigation system provided above, the following are illustrative examples of a vehicle mitigation system.

Example 1. A vehicle mitigation system comprising a first portable barrier, a second portable barrier positioned in proximity to the first portable barrier but separated by a spacing distance, and at least one arrestor cable attached between the first portable barrier and the second portable barrier such that the arrestor cable spans the spacing distance between the first and second portable barriers.

Example 2. The system of example 1, wherein the arrestor cable tethers the first and second portable barriers such that the barriers and arrestor cable are configured to absorb a kinetic energy of a vehicle and such that the first and second portable barriers move with the vehicle following contact.

Example 3. The system of examples 1 or 2, wherein the at least one arrestor cable further comprises a multi-strand metallic cable, a first releasable attachment hook at a first end of the arrestor cable, and a second releasable attachment hook at a second end of the arrestor cable, wherein the first releasable attachment hook is attached to the first portable barrier and the second releasable attachment hook is attached to the second portable barrier.

Example 4. The system of any of examples 1-3, wherein a length of the arrestor cable is greater than the spacing distance.

Example 5. The system of any of examples 1-4, wherein the at least one arrestor cable further comprises a first arrestor cable having a first end attached to the first portable barrier and a second end attached to the second portable barrier; a second arrestor cable having a first end attached to the first portable barrier and a second end attached to the second portable barrier; and a third arrestor cable having a first end attached to the first portable barrier and a second end attached to the second portable barrier.

Example 6. The system of example 5, wherein the first arrestor cable and the third arrestor cable are attached in a crossed configuration.

Example 7. The system of any of examples 1-6, wherein at least one vertically-oriented arrestor cable is attached between the first arrestor cable and the second arrestor cable.

Example 8. The system of any of examples 1-7, wherein the first end of the first arrestor cable, the first end of the second arrestor cable, and the first end of the third arrestor cable are each attached to a vertically-oriented plate of the first portable barrier; and the second end of the first arrestor cable, the second end of the second arrestor cable, and the second end of the third arrestor cable are each attached to a vertically-oriented plate of the second portable barrier.

Example 9. The system of any of examples 1-7, wherein the first arrestor cable, the second arrestor cable, and the third arrestor cable are horizontally aligned.

Example 10. The system of any of examples 1-9 further comprising a third portable barrier attached to the first portable barrier, and a fourth portable barrier attached to the second portable barrier.

Example 11. The system of example 10, wherein the third portable barrier is attached to the first portable barrier by at least one arrestor cable, and the fourth portable barrier is attached to the second portable barrier by at least one arrestor cable.

Example 12. The system of example 10, wherein the third portable barrier is rigidly attached to the first portable barrier, and the fourth portable barrier is rigidly attached to the second portable barrier.

Example 13. A method of slowing a vehicle comprising deploying a first portable barrier and a second portable barrier at a perimeter defense area, the first and second portable barriers separated by a spacing distance; attaching an arrestor cable to the first portable barrier and to the second portable barrier such that the arrestor cable spans the spacing distance between the first and second portable barriers.

Example 14. The method of example 13, wherein attaching an arrestor cable to the first portable barrier further comprises attaching a first end of a first arrestor cable to the first portable barrier; attaching a first end of a second arrestor cable to the first portable barrier; and attaching a first end of a third arrestor cable to the first portable barrier. Attaching an arrestor cable to the second portable barrier further comprises attaching a second end of the first arrestor cable to the second portable barrier; attaching a second end of the second arrestor cable to the second portable barrier; and attaching a second end of the third arrestor cable to the second portable barrier.

Example 15. The method of any of examples 13-14, wherein the arrestor cable further comprises a multi-strand metallic cable; a first releasable attachment hook at a first end of the arrestor cable; and a second releasable attachment hook at a second end of the arrestor cable.

Example 16. The method of example 15, wherein attaching an arrestor cable to the first portable barrier and to the second portable barrier further comprises attaching the first releasable attachment hook of the arrestor cable to a vertically-oriented plate of the first portable barrier; attaching an arrestor cable to the second portable barrier further comprises attaching the second releasable attachment hook of the arrestor cable to a vertically-oriented plate of the second portable barrier.

Example 17. The method of example 15, wherein attaching an arrestor cable to the first portable barrier and to the second portable barrier further comprises attaching the first releasable attachment hook of the arrestor cable to a horizontally-oriented plate of the first portable barrier; and attaching an arrestor cable to the second portable barrier further comprises attaching the second releasable attachment hook of the arrestor cable to a horizontally-oriented plate of the second portable barrier.

Example 18. The method of any of examples 13-17 further comprising deploying a third portable barrier and a fourth portable barrier at the perimeter defense area; attaching the third portable barrier to the first portable barrier; and attaching the fourth portable barrier to the second portable barrier.

Example 19. The method of example 18, wherein attaching the third portable barrier to the first portable barrier further comprises attaching at least one arrestor cable between the third portable barrier and the first portable barrier; and wherein attaching the fourth portable barrier to the second portable barrier further comprises attaching at least one arrestor cable between the fourth portable barrier and the second portable barrier.

Example 20. The method of example 18, wherein the third portable barrier is rigidly attached to the first portable barrier, and the fourth portable barrier is rigidly attached to the second portable barrier.

Although the present disclosure and its advantages have been described in detail, it should be understood that various changes, substitutions and alterations can be made herein without departing from the spirit and scope of the disclosure as defined by the following claims.

What is claimed is:

1. A vehicle mitigation system, comprising:

a first portable barrier;

a second portable barrier positioned in proximity to the first portable barrier but separated by a first spacing distance;

a third portable barrier positioned in proximity to the first portable barrier but separated by a second spacing distance;

first and second arrestor cables attached between the first portable barrier and the second portable barrier such that the first and second arrestor cables span the first spacing distance between the first and second portable barriers; and third and fourth arrestor cables attached between the first portable barrier and the third portable barrier such that the third and fourth arrestor cables span the second spacing distance between the first and third portable barriers;

wherein:

each of the first, second, third, and fourth arrestor cables is a multi-strand metallic cable;

each of the first, second, third, and fourth arrestor cables independently comprises a first releasable attachment hook at a first end of the arrestor cable and a second releasable attachment hook at a second end of the arrestor cable;

each of the first releasable attachment hooks is independently attached to the first portable barrier;

two of the second releasable attachment hooks are independently attached to the second portable barrier; and two of the second releasable attachment hooks are independently attached to the third portable barrier; and wherein each of the first, second, and third portable barriers comprises:

a base plate configured to vertically extend along a surface;

a front plate horizontally extending from and substantially perpendicular to the base plate, wherein the front plate comprises a forward face and a rear face;

a ramp extending from a front portion of the base plate to the forward face of the front plate;

a kick plate extending from the rear face of the front plate; and a wheel assembly positioned on a rear portion of the base plate.

2. The system of claim 1, further comprising a fourth portable barrier attached to the second portable barrier.

3. The system of claim 2, wherein the fourth portable barrier is attached to the second portable barrier by at least one arrestor cable.

4. The system of claim 2, wherein the fourth portable barrier is rigidly attached to the second portable barrier.

5. The system of claim 1, further comprising:

a fifth arrestor cable attached between the first portable barrier and the second portable barrier such that the fifth arrestor cable spans the spacing distance between the first and second portable barriers; and a sixth arrestor cable attached between the first portable barrier and the third portable barrier such that the sixth arrestor cable spans the spacing distance between the first and third portable barriers.

6. The system of claim 1, wherein each of the first releasable attachment hooks independently comprises an attached ring and a hook, wherein the attachment ring is attached to the first arrestor cable and the hook is attached to the first portable barrier.

7. The system of claim 6, wherein the hook is rotatably joined to the attachment ring by a pin.

8. The system of claim 6, wherein the hook further comprises a securement clasp configured to be spring biased into a closed position.

9. The system of claim 1, wherein each of the second releasable attachment hooks independently comprises an attached ring and a hook, wherein the attachment ring is attached to the second arrestor cable and the hook is attached to the second or third portable barrier.

10. The system of claim 9, wherein the hook is rotatably joined to the attachment ring by a pin.

11. The system of claim 9, wherein the hook further comprises a securement clasp configured to be spring biased into a closed position.

12. The system of claim 1, wherein the first or second spacing distance is greater than a width of the first portable barrier.

13. The system of claim 1, wherein each of the first, second, and third portable barriers further comprises a first vertically-oriented side plate extending along a first side of the base plate and the between the front portion and rear portion of the base plate, and a second vertically-oriented side plate extending along a second side of the base plate opposite the first side and the between the front portion and rear portion of the base plate.

14. The system of claim 1, wherein each of the first, second, and third portable barriers further comprises a first horizontally-oriented side plate extending along a first side of the base plate, and a second horizontally-oriented side plate extending along a second side of the base plate opposite the first side.

15. The system of claim 14, wherein:

the first and second arrestor cables are attached to the first horizontally-oriented side plate on the first portable barrier;

the third and fourth arrestor cables are attached to the second horizontally-oriented side plate on the first portable barrier;

the first and second arrestor cables are attached to the second horizontally-oriented side plate on the second portable barrier; and the third and fourth arrestor cables are attached to the first horizontally-oriented side plate on the third portable barrier.

16. The system of claim 1, wherein each of the first, second, and third portable barriers further comprises:

a first plurality of gussets supporting the ramp and connected to the base plate and the forward face of the front plate; and a second plurality of gussets supporting the kickplate and connected to the rear face of the front plate.

17. The system of claim 1, wherein at least the first spacing distance or the second spacing distance is about 48 inches or greater.

18. The system of claim 1, further comprising a row of teeth downwardly extending from the rear portion of the base plate.

19. A vehicle mitigation system, comprising:

a first portable barrier;

a second portable barrier positioned in proximity to the first portable barrier but separated by a first spacing distance;

a third portable barrier positioned in proximity to the first portable barrier but separated by a second spacing distance;

a first plurality of arrestor cables attached between the first portable barrier and the second portable barrier such that the first plurality of arrestor cables span the first spacing distance between the first and second portable barriers; and a second plurality of arrestor cables attached between the first portable barrier and the third portable barrier such that the second plurality of arrestor cables span the second spacing distance between the first and third portable barriers;

wherein:

each of the arrestor cables of the first and second pluralities independently comprises a first releasable attachment hook at a first end of the arrestor cable and a second releasable attachment hook at a second end of the arrestor cable;

each of the first releasable attachment hooks is independently attached to the first portable barrier; and each of the second releasable attachment hooks is independently attached to the second and/or third portable barrier; and wherein each of the first, second, and third portable barriers comprises:

a base plate configured to vertically extend along a surface;

a front plate horizontally extending from and substantially perpendicular to the base plate, wherein the front plate comprises a forward face and a rear face;

a ramp extending from a front portion of the base plate to the forward face of the front plate;

a kick plate extending from the rear face of the front plate; and a wheel assembly positioned on a rear portion of the base plate.

20. The system of claim 19, wherein the first plurality of arrestor cables comprises two or three arrestor cables, and wherein the second plurality of arrestor cables comprises two or three arrestor cables.

21. The system of claim 19, wherein each of the arrestor cables of the first and second pluralities is a multi-strand metallic cable.

22. The system of claim 19, wherein each of the first releasable attachment hooks independently comprises an attached ring and a hook, wherein the attachment ring is attached to the arrestor cable and the hook is attached to the first portable barrier.

23. The system of claim 22, wherein the hook is rotatably joined to the attachment ring by a pin.

24. The system of claim 22, wherein the hook further comprises a securement clasp configured to be spring biased into a closed position.

25. The system of claim 19, wherein each of the second releasable attachment hooks independently comprises an attached ring and a hook, wherein the attachment ring is attached to the arrestor cable and the hook is attached to the second or third portable barrier.

26. The system of claim 25, wherein the hook is rotatably joined to the attachment ring by a pin.

27. The system of claim 25, wherein the hook further comprises a securement clasp configured to be spring biased into a closed position.

28. The system of claim 19, wherein the first or second spacing distance is greater than a width of the first portable barrier.

29. A vehicle mitigation system, comprising:

a first portable barrier;

a second portable barrier positioned in proximity to the first portable barrier but separated by a first spacing distance;

a third portable barrier positioned in proximity to the first portable barrier but separated by a second spacing distance, wherein the first or second spacing distance is greater than a width of the first portable barrier;

a first plurality of arrestor cables attached between the first portable barrier and the second portable barrier such that the first plurality of arrestor cables span the first spacing distance between the first and second portable barriers; and a second plurality of arrestor cables attached between the first portable barrier and the third portable barrier such that the second plurality of arrestor cables span the second spacing distance between the first and third portable barriers;

wherein:

each of the first, second, and third portable barriers independently comprises a base plate comprising downwardly positioned teeth configured to contact a ground surface;

each of the arrestor cables of the first and second pluralities independently comprises a first releasable attachment hook at a first end of the arrestor cable and a second releasable attachment hook at a second end of the arrestor cable;

each of the first releasable attachment hooks is independently attached to the first portable barrier;

two or more of the second releasable attachment hooks are independently attached to the second portable barrier; and two or more of the second releasable attachment hooks are independently attached to the third portable barrier; and wherein each of the first, second, and third portable barriers comprises:

a base plate configured to vertically extend along a surface;

a front plate horizontally extending from and substantially perpendicular to the base plate, wherein the front plate comprises a forward face and a rear face;

a ramp extending from a front portion of the base plate to the forward face of the front plate;

a kick plate extending from the rear face of the front plate; and a wheel assembly positioned on a rear portion of the base plate.

* * * * *